US006685310B2

(12) United States Patent
Kaga et al.

(10) Patent No.: US 6,685,310 B2
(45) Date of Patent: Feb. 3, 2004

(54) INK-JET RECORDING APPARATUS

(75) Inventors: Hikaru Kaga, Aichi-ken (JP); Takamasa Usui, Ogaki (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/229,536

(22) Filed: Aug. 27, 2002

(65) Prior Publication Data

US 2003/0043244 A1 Mar. 6, 2003

(30) Foreign Application Priority Data

Aug. 28, 2001 (JP) ..... 2001-258104
Aug. 28, 2001 (JP) ..... 2001-258105

(51) Int. Cl.[7] ..... B41J 2/175
(52) U.S. Cl. ..... 347/87; 347/6; 347/30
(58) Field of Search ..... 347/6, 29, 30, 347/35, 86, 87, 92

(56) References Cited

U.S. PATENT DOCUMENTS 4,437,104 A * 3/1984 Hudson ..... 347/85
5,138,332 A * 8/1992 Carlotta ..... 347/87
5,812,155 A 9/1998 Seccombe
6,412,047 B2 * 6/2002 Shimizu et al. ..... 711/141
6,517,189 B2 * 2/2003 Ogawa et al. ..... 347/35
6,527,383 B1 * 3/2003 Lengyel et al. ..... 347/92

* cited by examiner

*Primary Examiner*—Anh T. N. Vo
(74) *Attorney, Agent, or Firm*—Reed Smith, LLP

(57) ABSTRACT

Ink supplied from an ink tank via a tube and air bubbles contained in the ink are stored in a first chamber of an air trap unit. At recording operation, the ink is allowed to flow from the first chamber to a third chamber via a filter disposed therebetween, and is supplied to a recording head via the third chamber. At purging operation, the ink flows at high speed, so that the filter regulates the high-speed ink-flow to flow from the first chamber to the third chamber. Therefore, the ink flows from the first chamber to a second chamber via a first connecting portion and then flows from the second chamber to the third chamber that connects a lower end of the second chamber with the recording head. Thus, the air trapped in the first chamber is discharged from the recording head along the high-speed ink-flow. In addition, a second rib is provided to an upper wall of the air trap unit so as to protrude in a direction perpendicular to an ink-flow direction. A space is provided by the second rib and the upper wall disposed downstream of the second rib in the ink-flow direction. With this structure, a predetermined amount of air remains in the air trap unit 11 even when the ink flows by a reset purging operation. Accordingly, the residual air in the air trap unit absorb a kinetic pressure due to inertia of the ink in the tube in accordance with the movement of a carriage.

26 Claims, 14 Drawing Sheets

INK-JET RECORDING APPARATUS

BACKGROUND OF THE INVENTION

1. Field of Invention

The invention relates to an ink-jet recording apparatus, and more particularly, to an ink-jet recording apparatus that traps air bubbles developed in an ink-flow passage to absorb a kinetic pressure produced in the ink-flow passage using the air bubbles and efficiently discharges the trapped air bubbles, thereby maintaining excellent printing quality.

2. Description of Related Art

There has been an ink-jet recording apparatus of ink tube supply type that supplies ink to a recording head via a tube from an ink tank. The ink-jet recording apparatus includes a recording head for ejecting ink droplets onto a recording medium to perform recording, a carriage on which the recording head is mounted, an ink tank that stores the ink to be supplied to the recording head, and a tube that supplies the ink from the ink tank to the recording head.

According to the ink-jet recording apparatus of the ink tube supply type, it is unnecessary to mount the ink tank on the carriage. Therefore, the recording head can become compact and lightweight, so that recording operation can be performed by moving the carriage at high speed. Further, an amount of storage capacity of the ink tank, which is separately provided from the recording head, can be increased. Thus, a replacing period of the ink tank (an ink supply period) can be elongated.

The recording head has an ink nozzle for ejecting an ink droplet therefrom. In order to eject ink stably from the ink nozzle, a meniscus of ink is formed at an end of the ink nozzle, for example, by controlling a pressure for supplying ink to the ink nozzle to a negative pressure within a predetermined level. Therefore, the ink supply pressure is maintained at a predetermined pressure to form the same meniscus all the time.

However, the recording head is mounted on the carriage that reciprocates to perform recording onto the recording medium. Acceleration and deceleration of the carriage movement provide a large acceleration to the recording head and the tube connected with the recording head. The acceleration generates a kinetic pressure in the ink in the tube. The kinetic pressure is transmitted to the recording head and breaks the meniscus formed at the ink nozzle. Accordingly, an ink droplet can not be stably ejected, so that recording quality is affected by the kinetic pressure.

SUMMARY OF THE INVENTION

The invention provides an ink-jet recording apparatus that can maintain excellent recording quality, by which air bubbles developed in an ink passage are stored in an air trap unit and a kinetic pressure generated in the ink passage is absorbed by the air bubbles.

According to one aspect of the invention, an ink-jet recording apparatus includes a recording head, an ink supply source, an ink passage, an air trap chamber, a purge device, a partition, and a filter. The recording head has at least one ink nozzle and performs recording onto a recording medium by ejecting ink from the ink nozzle. The ink supply source stores ink to be supplied to the recording head. The ink passage is connected to the ink supply source to supply ink from the ink supply source to the recording head. The air trap chamber has an upper wall, a bottom wall, side walls, and is connected to the ink passage to store air generated in the ink passage. The purge device generates an ink-flow that passes from the air trap chamber to the recording head and is faster than an ink-flow generated at the recording operation. The partition divides inside of the air trap chamber into a first chamber and a second chamber. the first chamber is connected with the ink supply source. Further the partition is provided in the air trap chamber so as to provide a first connecting portion that communicates the first chamber with the second chamber above the partition. The filter divides a lower portion of the air trap chamber into the first chamber at an ink supply source side and a third chamber at a recording head side. The third chamber connects the first chamber and a lower end of the second chamber with the recording head. The filter allows the ink to flow from the first chamber to the third chamber through the filter and offers resistance to the high-speed ink-flow generated by the purge device. In the inkjet recording apparatus, air is separated from the ink entered into the air trap chamber and is trapped at an upper portion of the first chamber, and the air trapped in the first chamber is discharged from the nozzles by the purge device that generates the high-speed ink-flow that passes the first, second and third chambers in order.

BRIEF DESCRIPTION OF THE DRAWINGS

An exemplary embodiment of the invention will be described in detail with reference to the following figures, wherein.

DETAILED DESCRIPTION OF THE PREFERRED EMBODIMENTS

Figure 1:
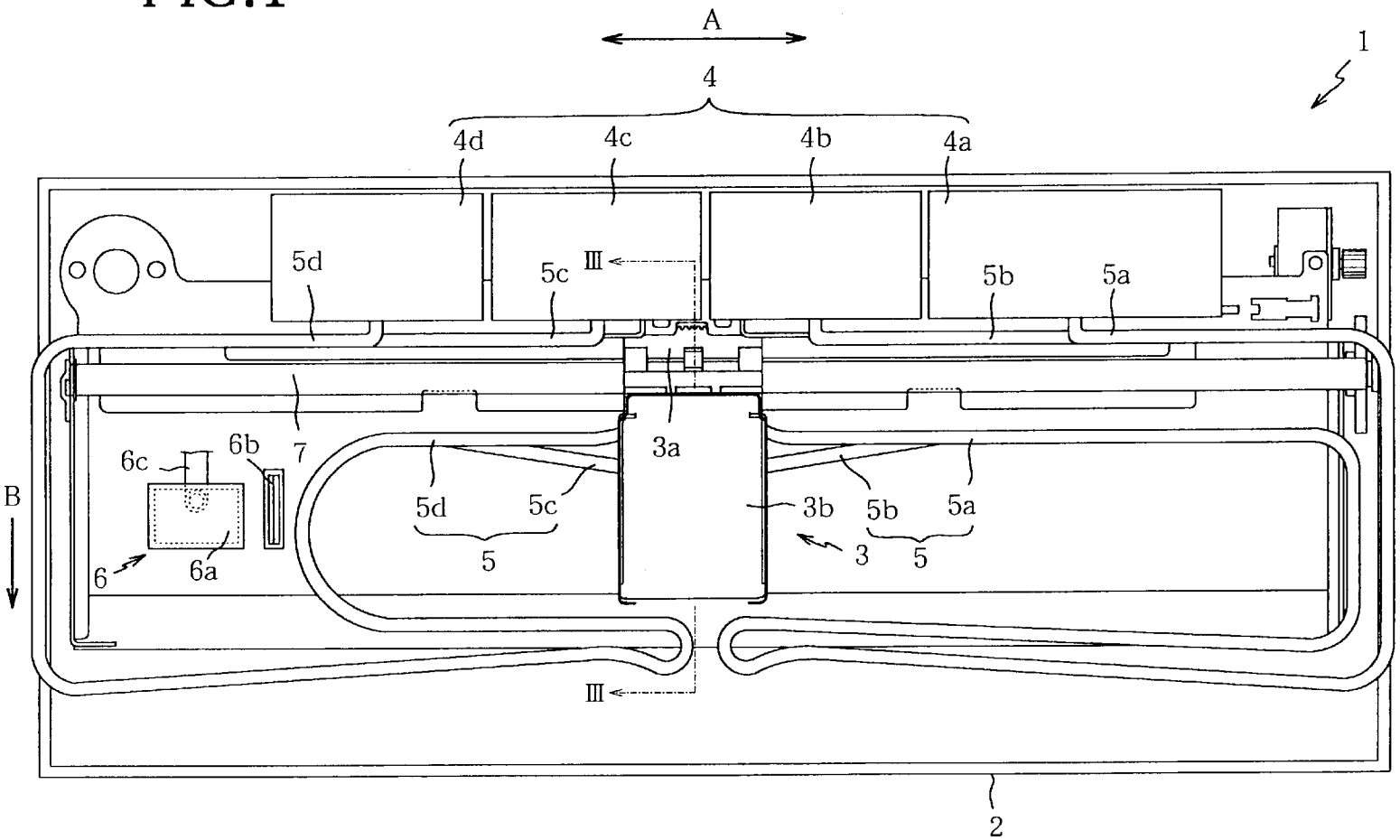
FIG. 1 a plan view showing an internal structure of an inkjet recording apparatus according to a first embodiment of the invention.
Figure 3:
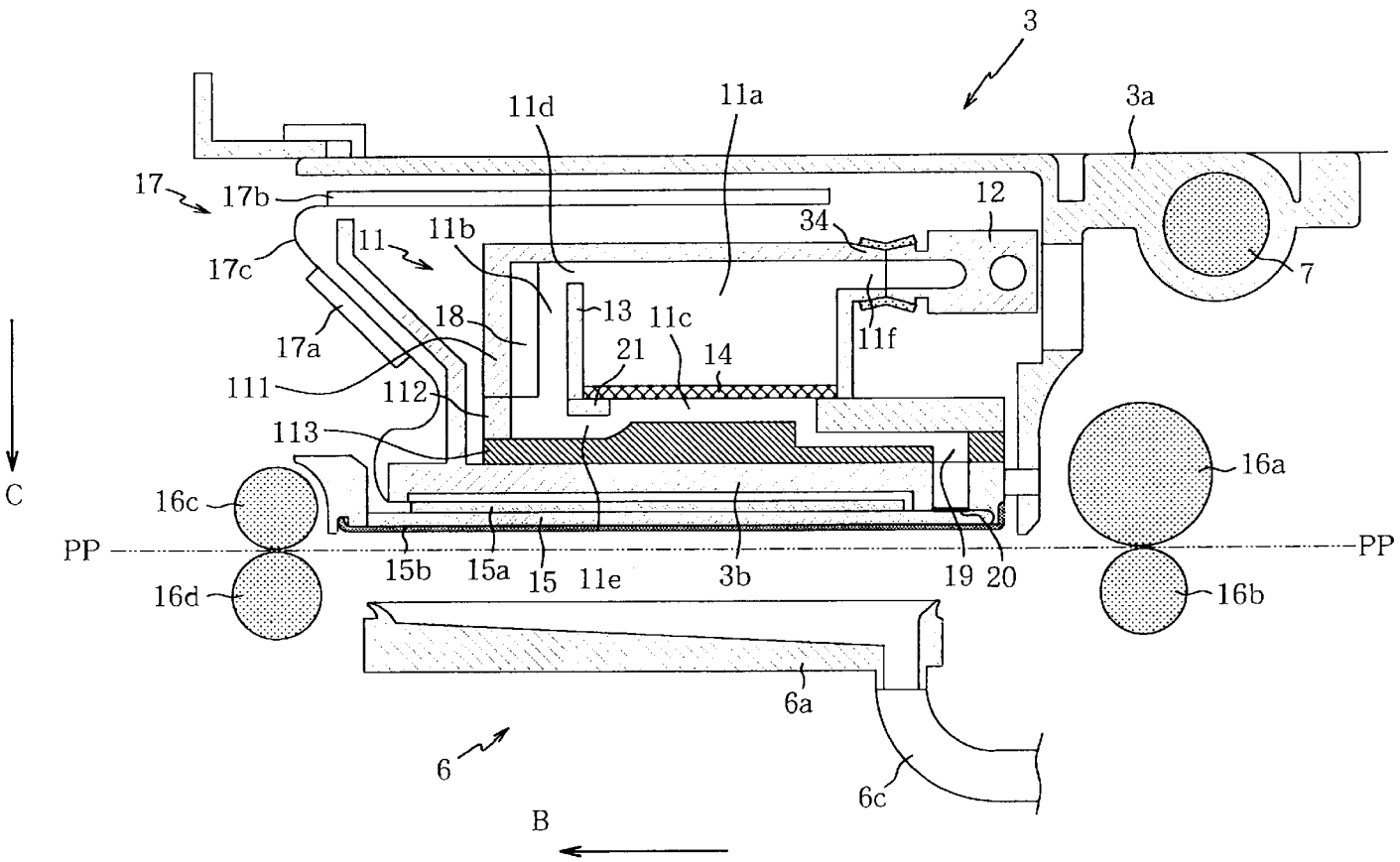
FIG. 3 is a sectional view taken along a line III—III of FIG. 1.

An exemplary embodiment of the invention will be described with reference to the accompanying drawings. As shown in FIG. 1, an ink-jet recording apparatus 1 includes a body frame 2, a recording head unit 3 provided in the body frame 2, an ink tank 4 (ink tanks 4*a* to 4*d*) for storing ink to be supplied to the recording head unit 3, a tube 5 (tubes 5*a* to 5*d*) for supplying the ink to the recording head unit 3 from the ink tank 4, a purge device 6, and sheet feed rollers 16*a* to 16*d* (FIG. 3). The recording head unit 3 ejects ink droplets onto a recording sheet PP. The ink tanks 4*a* to 4*d* each contains ink to be supplied to the recording head unit 3.

The body frame 2 is substantially in rectangular box shape and made of flame-retardant plastic. The body frame 2 contains the recording head unit 3 and other parts therein. A guide rod 7 is provided so as to extend in a longitudinal direction of the body frame 2. The guide rod 7 supports the recording head unit 3 so that the recording head unit 3 can reciprocate in directions indicated by an arrow A (right-and-left directions in FIG. 1) orthogonal to a sheet feed direction indicated by an arrow B.

Figure 2:
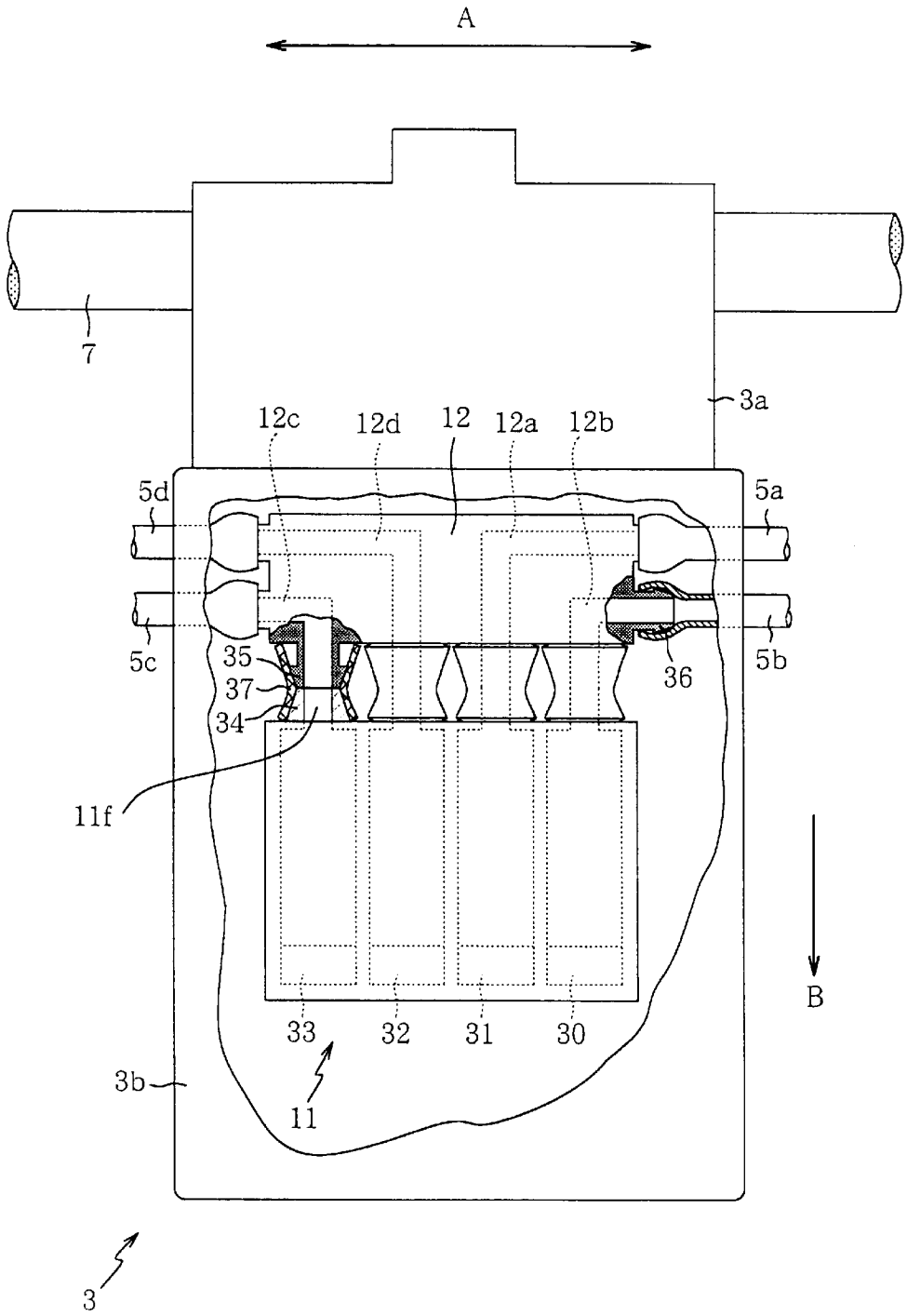
FIG. 2 is a plan view showing an internal structure of a recording head unit.

The recording head unit 3, having a box shape, includes a carriage 3*a* and a housing 3*b* connected to the carriage 3*a*. The recording head unit 3 contains a recording head 15 (FIG. 3) and an air trap unit 11 (FIG. 3) therein. The internal structure of the recording head unit 3 will be described below with reference to FIGS. 2 and 3.

Figure 4:
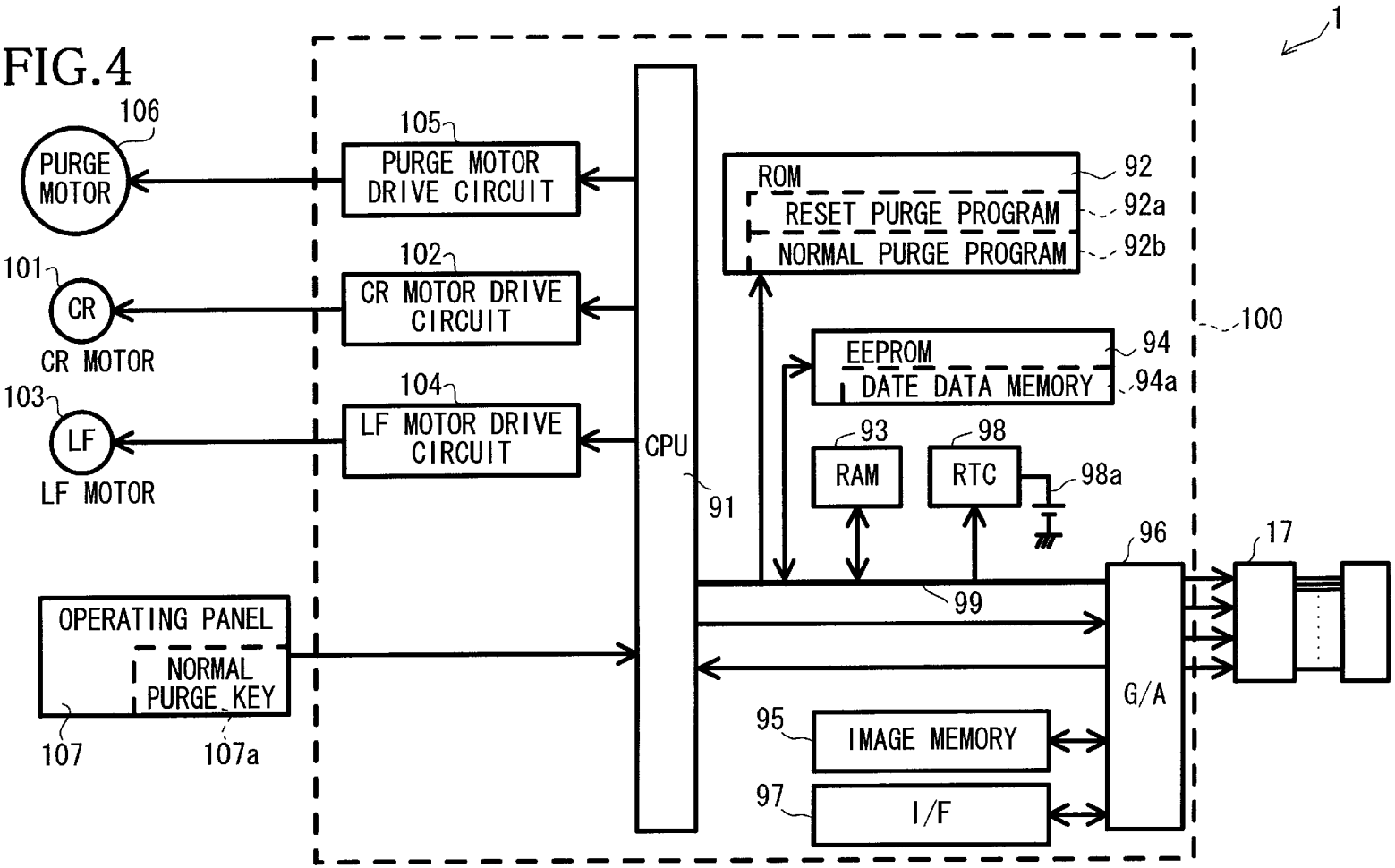
FIG. 4 is a block diagram of the inkjet recording apparatus.

The guide rod 7 is slidably inserted into the carriage 3*a* so that the carriage 3*a* can reciprocate along the guide rod 7. A belt (not shown) is attached to the carriage 3*a* and is wound around a roller (not shown) attached to a carriage (CR) motor 101 (FIG. 4). When the carriage motor 101 runs, the belt is driven, which allows the carriage 3*a* with the recording head unit 3 to move for the distance the belt is driven.

As shown in FIG. 3, the sheet feed rollers 16*a* to 16*d*, as a sheet feed device, are disposed at a lower position of the recording head unit 3 to feed the recording sheet PP in the sheet feed direction B. The sheet feed rollers 16*a*, 16*b* are placed upstream in the sheet feed direction B with respect to the recording head unit 3, and the sheet feed rollers 16*c*, 16*d* are placed downstream in the sheet feed direction B with respect to the recording head unit 3. The sheet feed rollers 16*a* to 16*d* feed the recording sheet PP in a substantially horizontal direction (the direction B) by rotation of a sheet feed (LF) motor 103 (FIG. 4).

The recording head unit 3 is equipped with a plurality of the recording heads 15 for recording in full color. Each of the recording heads 15 has a plurality of nozzles, which open downwardly to face the recording sheet PP. In this embodiment, for example, four recording heads 15 are provided, and each of the recording heads 15 has seventy-five nozzles aligned in a line. The recording heads 15 eject ink droplets from the nozzles by the action of piezoelectric actuators 15*a* provided on ink chambers, in the same manner as a well-know recording head. The ink is supplied to the recording heads 15 via connecting passages 19 of the air trap chambers which will be described in detail below. The recording heads 15 are supported at the undersurface of the housing 3*b* of the recording head unit 3. The recording units 15 of the recording sheet side are covered with a cover plate 15*b*, except the nozzles.

The ink tank 4 is designed to store ink to be supplied to the recording head unit 3, and disposed at a lower portion of a sheet feed path. In the embodiment, the ink tank 4 comprises four ink tanks 4*a* to 4*d* to store black, yellow, cyan, and magenta inks in the identified order. One end of each of the tubes 5*a* to 5*d* is attached to the corresponding ink tank 4*a* to 4*d* so as to supply the respective color ink of black, yellow, cyan and magenta to the recording head unit 3. The other end of each of the tubes 5*a* to 5*d* is connected to the recording head 15 for the corresponding color ink. The respective color inks are ejected from the recording heads 15, enabling full-color printing on the recording sheet PP.

The purge device 6 is provided on a left end of the body frame 2 to perform purging operation, which includes normal purging operation and reset purging operation. The purging operation is a process to recover the state of the ink to be ejected from the recording heads 15. The purge device 6 includes a suction cap 6*a*, a suction pump (not shown) that sucks ink from the print head unit 3 through the suction cap 6*a*, and a wiper 6*b* that wipes the surface of the ink nozzles formed in the recording head unit 3.

The suction cap 6*a*, having a substantially box shape, hermetically seals the nozzles of the recording heads 15. A discharge tube 6*c* is attached to the bottom of the suction cap 6*a*. Ink sucked by the action of the suction pump is discharged from the recording heads 15 via the suction cap 6*a* and the discharge tube 6*c*. The sucking operation is performed on the recording heads 15 one by one. When the sucking operation with respect to all the recording heads 15 is complete, the suction cap 6*a* is released from the nozzle surface of the last one. The nozzle surfaces become dirty with ink due to the purging operation, so that the nozzle surfaces are wiped using the plate-shaped rubber wiper 6*b* to remove the ink. Then, the purging operation is complete. The purging operation will be described in detail with reference to FIGS. 6 and 7. The purge device 6 may be designed to generate an ink-flow faster than that at the recording operation in the recording heads 15 by applying a high pressure to the ink from the ink tanks 4*a* to 4*d*.

A control circuit board 100 (FIG. 4), on which a CPU 91, a ROM 92, a RAM 93 and other control devices are mounted, is provided inside the body frame 2. The control circuit board 100 controls the ink-jet recording apparatus 1 according to control programs related to operation of the ink-jet recording apparatus 1. The purging operation by the purge device 6 is also controlled by the control circuit board 100.

An air trap unit 11, having a substantially box shape, is provided at the substantially center of the inside of the housing 3*b* of the recording head unit 3. The air trap unit 11 is designed to trap therein air bubbles, which are developed in the tubes 5*a* to 5*d* and included in the ink supplied to the air trap unit 11. The inside of the air trap unit 11 is divided into four air trap chambers 30 to 33 for the respective recording heads 15. Each of the air trap chambers 30 to 33 is provided, at its back wall (at an upper portion in FIG. 2), with a connector 34 protruding substantially straight to connect with a joint member 12.

The outer profile of each of the connectors 34 is tapered toward the joint member 12. A ink passage, that is an ink inlet 11*f* for the air trap chambers 30 to 33, is provided in the connectors 34. The joint member 12 connects the tubes 5*a*, 5*b*, 5*c* and 5*d* with the air trap chambers 31, 30, 33 and 32, respectively. The joint member 12, having a substantially box shape, is disposed behind the air trap unit 11 (at the upper position in FIG. 2). The joint member 12 has ink passages 12*a* to 12*d* separately. One end of each of the ink passages 12*a* to 12*d* is provided with a first connector 35 for connecting with the connector 34 of each of the air trap chambers 30 to 33. The other end of each of the ink passages 12*a* to 12*d* is provided with a second connector 36 for connecting with the respective tubes 5*a* to 5*d*.

The first connectors 35 substantially straightly protrude from a surface, opposed to the respective connectors 34 of the air trap chambers 30 to 33, of the joint member 12. A base portion of each of the first connectors 35 extends from the joint member 12 to the substantially middle portion of the first connectors 35. At the substantially middle portion, the outer profile becomes wider than that of base portion. The outer profile gradually becomes narrower from the middle potion so as to taper toward the connector 34. Each of the first connectors 35 is inserted into a hollow-body coupler 37 from its one end, and each of the connectors 34 is inserted into the coupler 37 from its other end. By doing so, The first connectors 35 are coupled to the respective connectors 34.

Two second connectors 36 protrude from each side surface of the joint member 12. A base portion of each of the second connectors 36 extends from the joint member 12 to the substantially middle portion of the second connectors 36. At the substantially middle portion, the outer profile becomes wider than that of base portion. The outer profile gradually becomes narrower from the middle potion so as to taper toward the tubes 5*a* to 5*d*. The second connectors 36 are connected with one ends of the corresponding tubes 5*a* to 5*d* while covered with the tubes 5*a* to 5*d*.

Each of the air trap chambers 30 to 33, in the air trap unit 11, are divided into a first chamber 11*a*, a second chamber 11*b*, and a third chamber 11*c*, by a partition wall 13 and a filter 14. All the air trap chambers 30 to 33 have the same structure, so that only one of them will be described below.

The first and second chambers 11*a* and 11*b* are separated from each other by the partition wall 13. The first chamber 11*a* is located on the side of the ink tank 4. The partition wall 13 separates the two chambers 11*a*, 11*b*, and a first connecting portion 11*d* is left open above the partition wall 13 so that the first and second chambers 11*a* and 11*b* communicate with each other via the first connecting portion 11*d*. The partition wall 13 extends from one side wall to another side wall in a width direction of the air trap unit 11 (in a direction from the near side to the far side in FIG. 3) and stands in a gravity direction indicated by an arrow C. The partition wall 13 is made of a material having high wettability to ink. For example, the partition wall 13 is made of a resin material such as polypropylene. Ozone treatments or plasma treatments are applied to the surfaces of the partition wall 13. Thus, the surfaces are rendered nonrepellant to ink or, in other words, have a high wettability to ink. It is, therefore, difficult for air bubbles to stay at the partition wall 13, so that air bubbles trapped in the first chamber 11*a* are easily led to an upper portion of the first chamber 11*a*.

The first chamber 11*a* and the third chamber 11*c* are separated from each other by the filter 14. The filter 14 has a resistance to the ink-flow such that the filter 14 allows ink to flow from the first chamber 11*a* to the third chamber 11*c* via the filter 14 when the ink flows at low speed at the recording operation, and regulates the ink-flow from the first chamber 11*a* to the third chamber 11*c* via the filter 14 when ink flows fast at the purging operation. The filter 14 is a meshed net made of stainless steel having openings. The filter 14 also serves as a bottom wall of the first chamber 11*a* and is disposed in a substantially horizontal position. The filter 14 has a rectangular shape, in which longer sides of the filter 14 extend in a direction perpendicular to the width direction of the air trap unit 11 (in a direction parallel to a width direction of the partition wall 13). In an alternative embodiment of the invention, instead of the filter 14, a bottom wall having an opening that can be opened and closed by a valve, can be provided. The valve is urged in an opening direction. When ink flows at low speed, the valve is kept open so that ink can flow through the opening. When ink flows fast, the valve is closed or restricted by the ink-flow to control the ink-flow.

The first chamber 11*a* is located on the side of the ink tank 4. In the first chamber 11*a*, one side wall is the partition wall 13, and the bottom wall is the filter 14. The first chamber 11*a* communicates with the second chamber 11*b* via the first connecting portion 11*d* at the upper portion of the first chamber 11*a* (above the partition wall 13). The other side wall of the first chamber 11*a* is formed with the ink inlet 11*f* at its upper portion. Ink is supplied to the first chamber 11*a* from the ink tank 4 through the tube 5, the joint member 12 and the ink inlet 11*f* in this order. At that time, air bubbles flows into the first chamber 11*a* together with the ink. In the first chamber 11*a*, the air bubbles move up by its buoyancy and is trapped at the upper portion of the first chamber 11*a*.

The second chamber 11*b* is located next to the first chamber 11*a*, sandwiching the partition wall 13 therebetween. One of side walls of the second chamber 11*b* is the partition wall 13. The second chamber 11*b* communicates with the first and third chambers 11*a* and 11*c* respectively via the first connecting portion 11*d* at the upper portion and at a second connecting portion 11*e* provided under the partition wall 13. In the second chamber 11*b*, ink flows in a direction from top to bottom. A cross-sectional area of the second connecting portion 11*e* is restricted by a wall 21 provided at the bottom of the partition wall 13. This cross-sectional area is smaller than the cross-sectional area of the second chamber 11*b* orthogonal to the ink-flow direction in the second chamber 11*b*. A rib 18 protrudes from a side wall (not the partition wall 13) of the second chamber 11*b* which is adjacent to the partition wall 13. The rib 18 extends in a vertical direction. The rib 18 divides the inside of the second chamber 11*b* into two sections to cause capillary action to raise the ink level of the second chamber 11*b* to the first connecting portion 11*d*. A plurality of ribs 18 may be provided in the second chamber 11*b* as necessity.

The level of ink stored in the second chamber 11*b* is raised to the first connecting portion 11*d* by the capillary action of the rib 18 during the recording operation. When the purging operation is performed, the ink-flow from first chamber 11*a* to the third chamber 11*c* through the filter 14 is restricted by the resistance of the filter 14. Thus, an ink-flow, that goes through the first, second and third chambers 11*a*, 11*b*, 11*c* and through the first and second connecting portions 11*d* and 11*e*, is generated. The air trapped in the first chamber 11*a* is discharged from the recording head unit 3, passing through the first, second and third chambers 11*a* to 11*c*, in this order, along the ink-flow. An inner wall of the second chamber 11*b* is made of a material having high wettability to ink or the surface of the inner wall is finished to improve wettability to ink. For example, the inner wall is made of a resin material such as polypropylene. Ozone treatments or plasma treatments are applied to the surfaces of the inner wall. Thus, the surfaces are rendered nonrepellant to ink or, in other words, have a high wettability to ink. It is, therefore, difficult for air bubbles to stay at the inner wall. Thus, air, passing through the second chamber 11*b* at the purging operation (the reset purging operation), can be easily and quickly discharged.

The third chamber 11*c* is located under the first chamber 11*a* (on the side of the recording heads 15), sandwiching the filter 14 therebetween. An upper wall of the third chamber 11*c* is the filter 14. One end (the right side in FIG. 3) of the third chamber 11*c* communicates with a connecting passage 19, which connects the recording head 15, and the other end communicates the second chamber 11*b* via the second connecting portion 11*e*. At the recording operation, ink is supplied from the first chamber 11*a* to the third chamber 11*c* through the filter 14, and then supplied to the recording heads 15. At the purging operation (the reset purging operation), air flows from the second chamber 11*b* to the third chamber 11*c* via the second connecting portion 11*e*, and then is discharged from the recording heads 15.

A passage filter 20 is provided at the connecting passage 19 to catch contaminants contained in the ink before supply to the recording heads 15. The passage filter 20 is a meshed net made of stainless steel having openings, and extends over the entire connecting passage 19 in its cross-sectional direction.

The air trap unit 11 comprises a box member 111, and frame members 112, 113, which are stacked on one another. The box member 111 includes the first chamber 11*a,* the upper parts of the second chamber 11*b* and the partition wall 13 of the air trap chambers 30 to 33. The frame member 112 includes the lower parts of the second chamber 11*b,* the peripheries of the third chamber 11*c,* and the wall 21. The frame member 113 includes the bottom walls of the second and third chambers 11*b,* 11*c,* and the connecting passage 19.

A carriage control circuit board 17 for sending drive signals to drive the recording heads 15 includes a driver circuit board 17*a* and an interface circuit board 17*b*. The driver circuit board 17*a* is provided at the surface of the housing 3*b,* on the left of the print head unit 3. The driver circuit board 17*a* is controlled by the control circuit board 100 mounted on the ink-jet recording apparatus 1. The driver circuit board 17*a* changes serial signals sent by the control circuit board 100 into parallel signals corresponding to the actuators 15*a* in order to control the actuators 15*a*.

The interface circuit board 17*b* is placed at the upper portion of the air trap unit 11. The interface board 17*b* is provided with a connector which connects signal wires from the control circuit board 100 and a noise reduction circuit. In addition, the interface board 17*b* is connected to flexible printed circuit boards 17*c,* which connect with the actuators 15*a,* and the driver circuit board 17*a* provided on the printed circuit boards 17*c*.

Referring to FIG. 4, the electronics of the ink-jet recording apparatus 1 will be described. The control circuit board 100 for controlling the ink-jet recording apparatus 1 is provided with the one-chip microcomputer (CPU) 91, the ROM 92 for storing fixed value data and various control programs to be executed by the CPU 91, the RAM 93 for temporarily storing various data, an EEPROM 94, an image memory 95, a gate array (G/A) 96, and a real time clock (RTC) 98.

The CPU 91 generates print timing signals and reset signals and sends the signals to the gate array 96, as well as executing the purging operation, in accordance with the control programs prestored in the ROM 92. The CPU 91 is connected with an operating panel 107, a carriage (CR) motor drive circuit 102, a sheet feed motor drive circuit 104, and a purge motor drive circuit 105. The operating panel 107 is used by a user to instruct operations, such as recording operation. The carriage motor drive circuit 102 drives a carriage (CR) motor 101 that moves the carriage 3*a*. The sheet feed motor drive circuit 104 drives a sheet feed (LF) motor 103 that conveys a recording sheet PP. The purge motor drive circuit 105 drives a purge motor 106 that actuates the suction pump. The purge motor 106 is a stepping motor, wherein the number of rotations of the purge motor 106 can be controlled by the number of pulses to be inputted.

Figure 6:
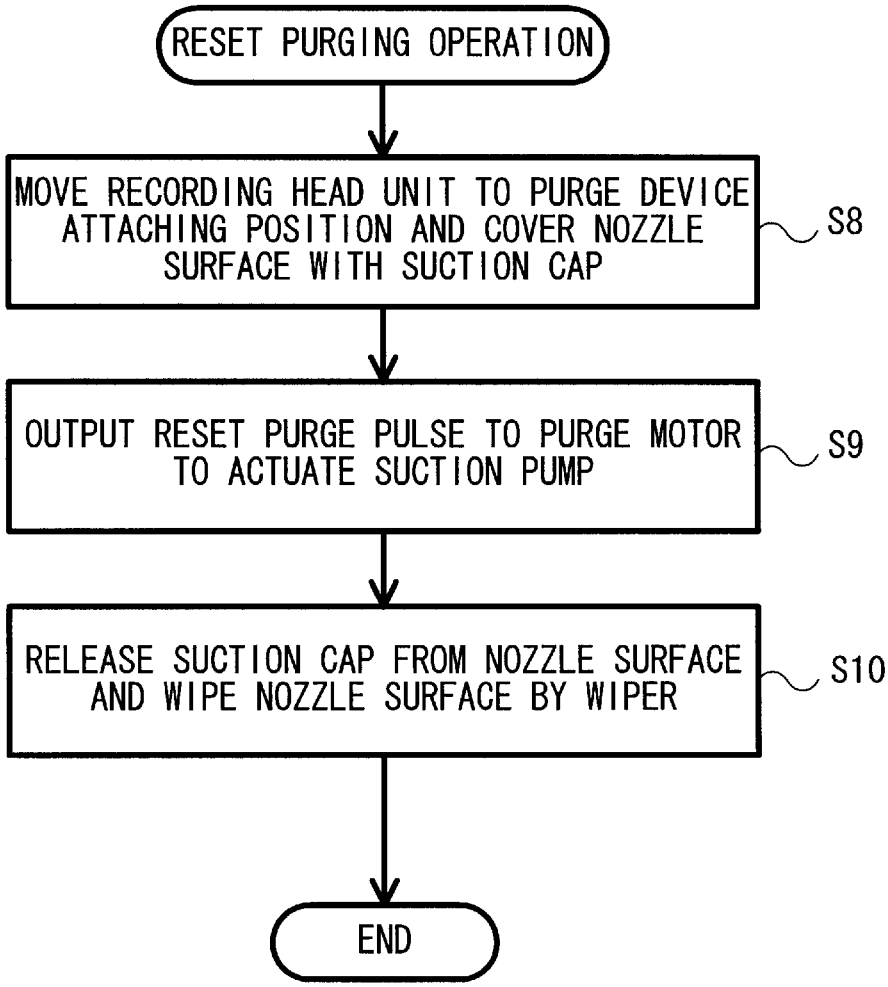
FIG. 6 is a flowchart of reset purging operation.

The ROM 92 stores a reset purge program 92*a* and a normal purge program 92*b,* as part of the control programs. The reset purge program and the normal purge program are written using C programming language. The ROM 92 is a flash ROM at first. Then, the flash ROM 92 is masked and becomes a mask ROM 92. The reset purge program 92*a* is a program for executing a reset purging operation (FIG. 6). The reset purging operation is a process to discharge most of the air trapped in the air trap unit 11 from the nozzles. The reset purge program 92 is executed based on date data stored in a date data memory 94*a* in the EEPROM 94.

Figure 7:
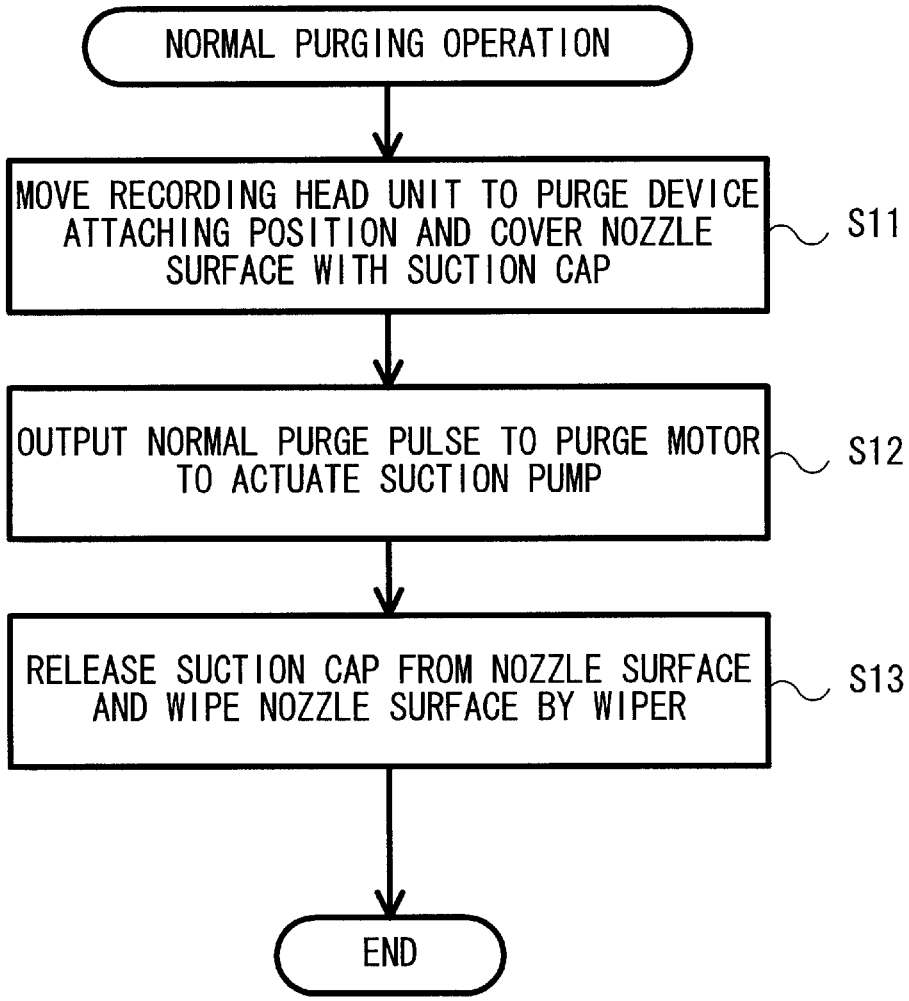
FIG. 7 is a flowchart of normal purging operation.

The normal purge program 92*b* is a program for executing a normal purging operation (FIG. 7). The normal purging operation is a process to suck air bubbles, paper dust, dried and solidified ink, which may clog the nozzles, by a suction force that is weaker than that at the reset purging operation. At the normal purging operation, air trapped in the air trap unit 11 is not discharged. This operation is performed when the a purge key 107*a* provided on the operating panel 107 is pressed by the user.

The EEPROM 94, including the date data memory 94*a,* is a nonvolatile memory that saves stored contents even when the power of the ink-jet recording apparatus 1 is turned off. The date data memory 94*a* stores the date when the latest reset purging operation was performed. Every time the reset purging operation is performed, the date data is updated.

The RTC 98 is an IC that measures time, such as a year, month, and date. According to measured values of the RTC 98, the date when the reset purging operation was performed is stored in the date data memory 94*a*. The RTC 98 is connected with a battery circuit 98*a* that supplies a voltage for battery backup when the power of the ink-jet recording apparatus 1 is turned off. With the provision of the battery circuit 98*a,* the time can be continuously measured after the power of the ink-jet recording apparatus 1 is turned off.

The gate array 96 outputs print data (drive signals) for recording image data onto a recording sheet PP, a transfer clock that synchronizes with the print data, a latch signal, a parameter signal for generating a basic print waveform signal, and an ejection timing signal to be outputted at regular timing, based on a print timing signal to be transferred from the CPU 91 and image data stored in the image memory 95. Then, the gate array 96 transfers those signals to the carriage control circuit board 17. The gate array 96 also stores image data transferred from external equipment, such as a computer, via a Centro interface (I/F) 97, into the image memory 95. Then, the gate array 96 generates a Centro data reception interrupting signal based on Centro data transferred from a host computer via the Centro interface 97, and transfers the signal to the CPU 91. The signals to be transmitted between the gate array 96 and the carriage control circuit board 17 are transmitted via a harness cable (not shown) connecting them. The CPU 91, the ROM 92, the RAM 93, and the gate array 96 are connected each other via a bus line 99.

Figure 5:
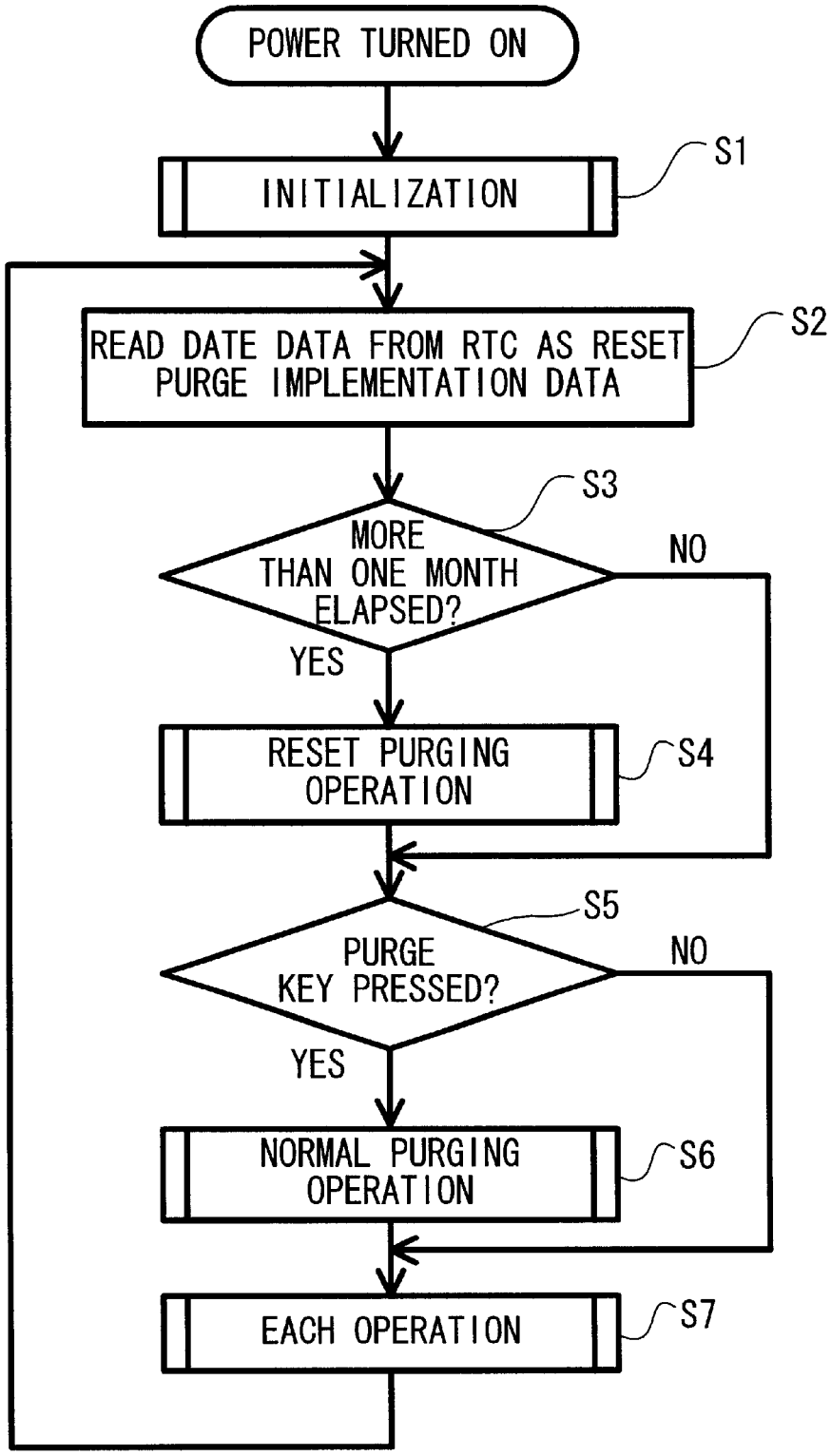
FIG. 5 is a flowchart of a sequence of operation executed in the ink-jet recording apparatus.

The reset purging operation and the normal purging operation will be described with reference to FIGS. 5 to 7. First, referring to FIG. 5, each purging operation will be described along a series of operation to be implemented in the ink-jet recording apparatus 1. As shown in FIG. 5, when the power of the ink-jet recording apparatus 1 is turned on, initialization is performed (Step 1, hereinafter, S stands for a step). At the initialization, positioning for specifying a position of the recording head unit 3 and clearing for clearing data stored in the RAM 93 are implemented. When the initialization is complete, date data is read from the RTC 98 as reset purging implementation data (S2). The read date data and the preceding reset purge date data stored in the date data memory 94*a* are compared with each other. As a result, when it is determined that more than one month has elapsed since the last reset purging operation was performed (S3:Yes), the reset purging operation (S4) is performed. At that time, the date data currently stored in the date data memory 94*a* is replaced with date data newly read from the RTC 98.

Referring FIG. 6, the reset purging operation will be described. The reset purging operation is performed based on the reset purge program 92*a* stored in the ROM 92. First, the carriage motor 101 is driven to move the recording head unit 3 to a position where the purge unit 6 is attached to the recording head unit 3. Then, the suction cap 6*a* is attached to the nozzle surface of the recording head unit 3 (S8) to intimately cover the nozzle surface. After that, a reset purge pulse is outputted to a purge motor 106. The number of reset purge pulses to be outputted is greater than that of normal purge pulses (described later) to be outputted at the normal purging operation. Therefore, the number of rotations of the purge motor 106, such as a stepping motor, is greater than that at the normal purging operation. The purge motor 106 actuates the suction pump with a suction pressure of approximately 80 kPa (S9).

Then, air trapped in the air trap unit 11 is sucked from the nozzles by the action of the suction pump. At that time, ink discharged with the air is discharged through the discharge tube 6*c* connected to the suction cap 6*a*. When the sucking operation is complete, the suction cap 6*a* is released from the nozzle surface and then the nozzle surface is wiped using the wiper 6*b* (S10). Thus, the reset purging operation is complete. As described above, air bubbles trapped in the air trap unit 11 is discharged from the nozzles to recover ink ejecting condition.

Referring again FIG. 5, when it is determined that the lapse of days is less than one month since the power of the brand-new ink-jet recording apparatus 1 was turned on for a first use or since the last reset purging operation was performed (S3:No), it is determined whether the purge key 107*a* has been pressed. When the purge key 107*a* has been pressed (S5:Yes), the normal purging operation is implemented (S6).

The normal purging operation will be described with reference to FIG. 7. The normal purging operation is performed based on the normal purge program 92*b* stored in the ROM 92. First, similar to the reset purging operation, the carriage motor 101 is driven to move the recording head unit 3 to the position where the purge unit 6 is attached to the recording head unit 3. Then, the suction cap 6*a* is attached to the nozzle surface of the recording head unit 3 (S11) to intimately cover the nozzle surface. After that, a normal purge pulse is outputted to the purge motor 106. The number of normal purge pulses to be outputted is less than that of reset purge pulses to be outputted at the reset purging operation. Therefore, the number of rotations of the purge motor 106 is less than that of the purge motor 106 at the reset purging operation. The purge motor 106 actuates the suction pump with a suction pressure of approximately 50 kPa (S12).

Thus, air bubbles, paper dust and solidified ink, which accumulated in the nozzles, are sucked by the action of the suction pump. At that time, ink is sucked and discharged through the discharge tube 6*c* connected to the suction cap 6*a*. When the sucking operation is complete, the suction cap 6*a* is released from the nozzle surface and then the nozzle surface is wiped using the wiper 6*b* (S13). Thus, the normal purging operation is complete. As described above, at the normal purging operation, suction is performed with pressure lower than that at the reset purging operation. Thus, air trapped in the air trap unit 11 is not discharged, but air bubbles clogging the nozzles, paper dust, and solidified ink are sucked and discharged from the nozzles to recover the ink ejecting condition.

Referring FIG. 5, when it is determined that the normal purging operation has just finished or the purge key 107*a* is not pressed (S5:No), neither the reset purging operation nor the normal purging operation is performed, but the normal operation, such as recording operation, is performed (S7).

Referring to FIGS. 8A to 8F, ink-flow patterns and the condition of the trapped air will be described. FIGS. 8A to 8F schematically show operation of the air trap chambers 30 to 33. In FIGS. 8A to 8F, ink and air bubbles flow from the tube 5 into the air trap unit 11 via the ink inlets 11*f* in a direction indicated by a left arrow and the ink and air bubbles are discharged from the air trap unit 11 in a direction indicated by a down arrow.

Figure 8A:
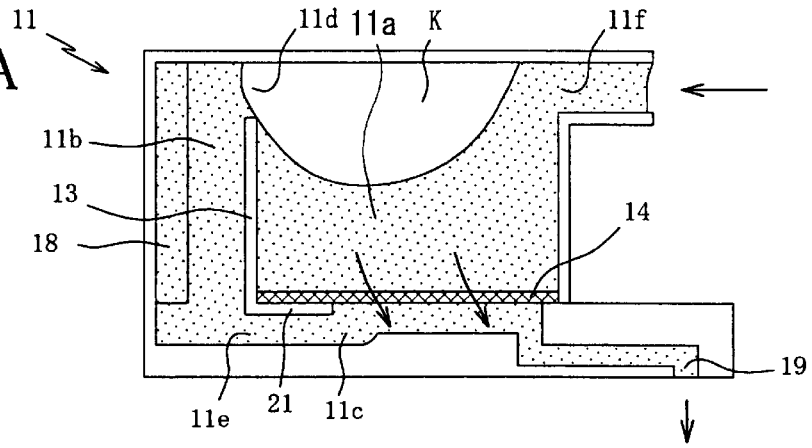
FIGS. 8A to 8F are sectional views schematically showing operation of an air trap unit of the first embodiment of the invention.

FIG. 8A shows the air trap unit 11 wherein an appropriate amount of air is trapped after a certain time has elapsed since the reset purging operation was finished. When recording operation is performed, ink stored in the first chamber 11*a* flows into the third chamber 11*c* through the filter 14, and then the ink is supplied to the recording head 15 from the third chamber 11*c*. In accordance with consumption of the ink in the air trap chamber 11, ink stored in the ink tank 4 is supplied to the first chamber 11*a* via the tube 5. At that time, air bubbles contained in the ink also flows into the first chamber 11*a* with the ink. The air bubbles move up to the upper portion of the first chamber 11*a* by its own buoyancy and accumulate at the upper portion, thereby becoming an air bubble K.

The ink level of the second chamber 11*b* is raised to the first connecting portion 11*d* by the capillary action of the rib 18. Thus, even when the air bubble K in the first chamber 11*a* becomes large and this results in lowering the ink level of the first chamber 11*a,* the ink level of the second chamber 11*b* is still maintained at the first connecting portion 11*d*. The first connecting portion 11*d* is a substantially rectangular hole having a width of approximately 3.5 mm and a height of approximately 1.5 mm, so that the ink level raised to the first connecting portion 11*d* forms a concave meniscus. Accordingly, the ink maintained at the first connecting portion 11*d* in the second chamber 11*b* do not flow into the first chamber 11*a,* thereby maintaining the ink level in the second chamber 11*b* at the first connecting portion 11*d*.

Figure 8B:
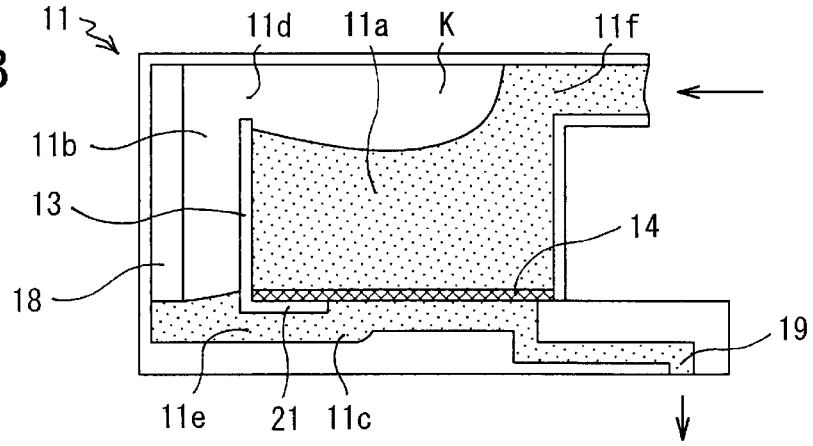

FIG. 8B shows a state of the inside of the air trap unit 11 at the normal purging operation. The normal purging operation is a process to discharge air bubbles and paper dust, which may clog the nozzles, from the nozzles. At this operation, suction is performed with respect to the recording heads 15 with pressure higher than that at the recording operation, so that the ink in the air trap unit 11 flows fast. The high-speed ink-flow, generated by the suction, is regulated to go from the first chamber 11*a* to the third chamber 11*c* by a resistance of the filter 14. Thus, the ink in the first chamber 11*a* goes into the second chamber 11*b* through the first connecting portion 11*d,* and then goes into the third chamber 11*c* through the second connecting portion 11*e*. The resistance of the filter 14 to the high-speed ink-flow is large under the high pressure. Therefore, ink-flow is generated from the first chamber 11*a* to the third chamber 11*c* through the second chamber 11*b,* which have the less resistance to the ink-flow.

The air bubble K trapped in the first chamber 11*a* is drawn into the second chamber 11*b* by the normal purging operation, because the lower portion of the second chamber 11*b* communicates with the third chamber 11*c* via the second connecting portion 11*e* so that the resistance to the ink-flow in the second chamber 11*b* is smaller than the resistance of the filter 14 to the ink-flow. The pressure to be produced at the normal purging operation is lower than that to be produced at the reset purging operation. The normal purging operation is performed using such pressure in a condition where the ink level in the second chamber 11*b* is maintained at the first connecting portion 11*d* by the capillary action of the rib 18. Therefore, the air bubble K which is led to the second chamber 11*b* is not further led to the third chamber 11*c*. Accordingly, at the normal purging operation, air trapped in the air trap unit 11 is not discharged from the nozzles, but air bubbles and paper dust, which may clog the nozzles, are sucked and discharged from the recording head unit 3.

Figure 8C:
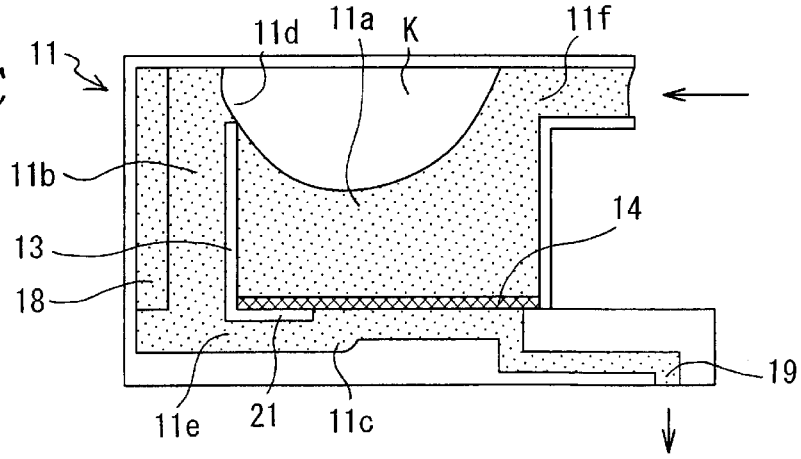

FIG. 8C shows a condition of the air trap unit 11 after the normal purging operation. The air bubble K, once drawn into the second chamber 11*b* by the normal purging operation as shown in FIG. 8B, moves up by its own buoyancy and the capillary action of the rib 18, and is led to the first chamber 11*a* again and trapped therein.

Figure 8D:
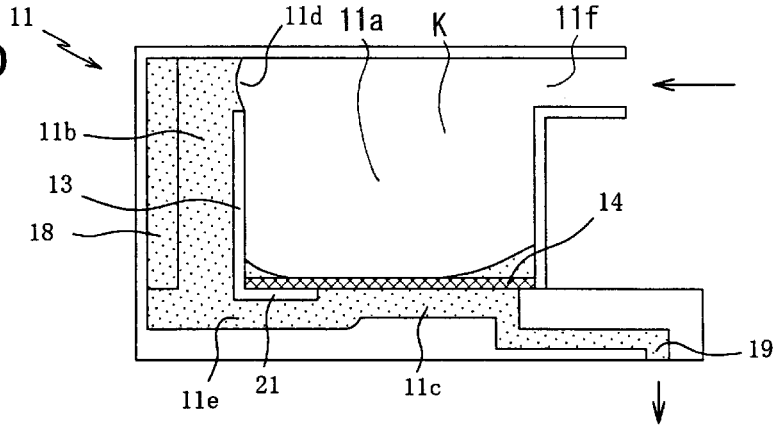

FIG. 8D shows the air trap unit 11 wherein the volume of trapped air is increased. The air trap unit 11 traps a large amount of air in the first chamber 11*a*. This condition may cause an ink ejection failure for lack of ink. In the ink-jet recording apparatus 1 of the embodiment, it is assumed that such the condition will occur by approximately one month. However, a period of the occurrence of such the condition can be set arbitrarily.

Figure 8E:
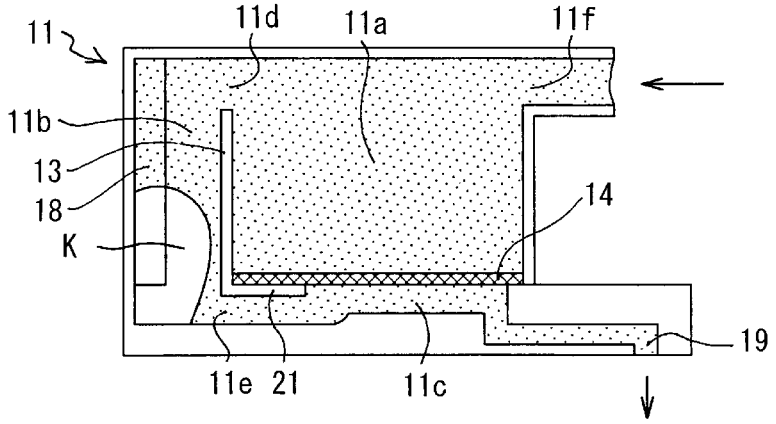

FIG. 8E shows a condition of the air trap unit 11 at the reset purging operation. When the condition of the air trap unit 11 becomes that as shown in FIG. 8D, the reset purging operation is performed. The reset purging operation is a process to discharge excessive air trapped in the first chamber 11*a*. At the reset purging operation, the recording heads 15 are sucked using pressure higher than that produced at the normal purging operation, so that a high-speed ink-flow is regulated to flow from the first chamber 11*a* to the third chamber 11*c*. In this case, similar to the normal purging operation, an ink-flow that goes from the first chamber 11*a* to the second chamber 11*b* and then goes to the third chamber 11*c* via the first and second connecting portions 11*d* and 11*e*, is generated.

The air bubble K trapped in the first chamber 11*a* is also sucked and discharged through the first to third chambers 11*a* to 11*c*, along the ink-flow. At the normal purging operation, the air bubble K is not led to the third chamber 11*c*. At the reset purging operation, however, the force of the suction is stronger than that at the normal purging operation, so that the air bubble K is led to the third chamber 11*c* through the second chamber 11*b*. The cross-sectional area of the second connecting portion 11*e* is smaller than that of the second chamber 11*b* orthogonal to the ink-flow direction in the second chamber 11*b*. Accordingly, the speed of the ink flowing from the second chamber 11*b* to the second connecting portion 11*e* becomes fast, and thus, the air K can be mightily discharged with the ink from the nozzles. The second chamber 11*b* and the third chamber 11*c* meets at substantially right angles to connect each other. With this structure, the ink-flow stagnates at the corner (the intersection of the second chamber 11*b* and the third chamber 11*c*). As a result, part of the air K remains at the stagnation portion. A large amount of ink is supplied from the ink tank 4 to fill the air trap unit 11 with ink by the reset purging operation.

Figure 8F:
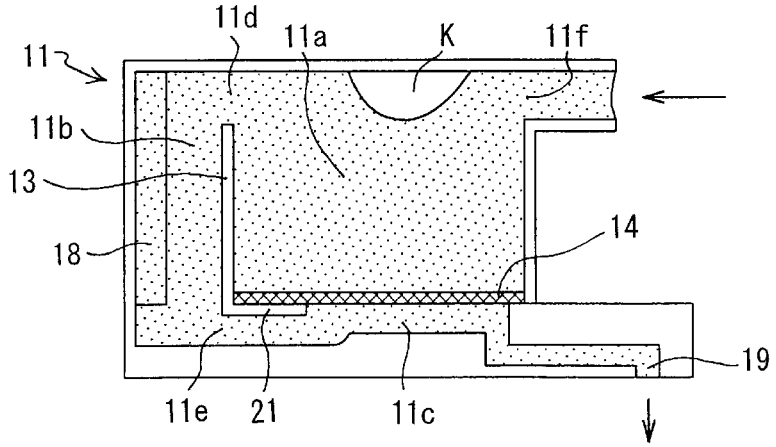

FIG. 8F shows the air trap unit 11 after the reset purging operation. An air K remaining in the second chamber 11*b* as shown in FIG. 8E moves up to the upper portion of the second chamber 11*b* by its own buoyancy and the capillary action of the rib 18. Then, the residual air K goes into the first chamber 11*a* via the first connecting portion 11*d*, and thus trapped at the upper portion of the first chamber 11*a*. As described above, the first connecting portion 11*d* maintains the ink level of the second chamber 11*b* thereat and is a large enough to pass the residual air K therethrough from the second chamber 11*b* to the first chamber 11*a*. The residual air K trapped in the first chamber 11*a* absorbs a kinetic pressure due to inertia of the ink in the tube 5 in accordance with the movement of the carriage 3*a*. The amount of residual air is preferably between 0.05 cc and 0.2 cc.

According to the ink-jet recording apparatus 1 including the above-described air trap unit 11, air bubbles generated in the tube 5 are trapped in the air trap unit 11 provided at some midpoint in the ink passage. Therefore, the air bubbles, which may clog the nozzles, do not reach the recording heads 15, so that an occurrence of the ink ejection failure can be avoided. Further, at the reset purging operation (S4), the filter 14 regulates the ink-flow that goes from the first chamber 11*a* to the third chamber 11*c* via the filter 14, in order to generate the high-speed ink-flow that passes through the first, second and third chambers 11*a*, 11*b*, 11*c*. Accordingly, the air trapped in the first chamber 11*a* can be discharged from the recording head unit 3.

The air trap chambers 30 to 33 of the air trap unit 11 can be structured as described below. Referring to FIGS. 9, and 10A to 10G, a variation of the invention of a structure and operation for preserving air in the first chamber 11*a* to absorb a kinetic pressure at the reset purging operation will be described.

Figure 9:
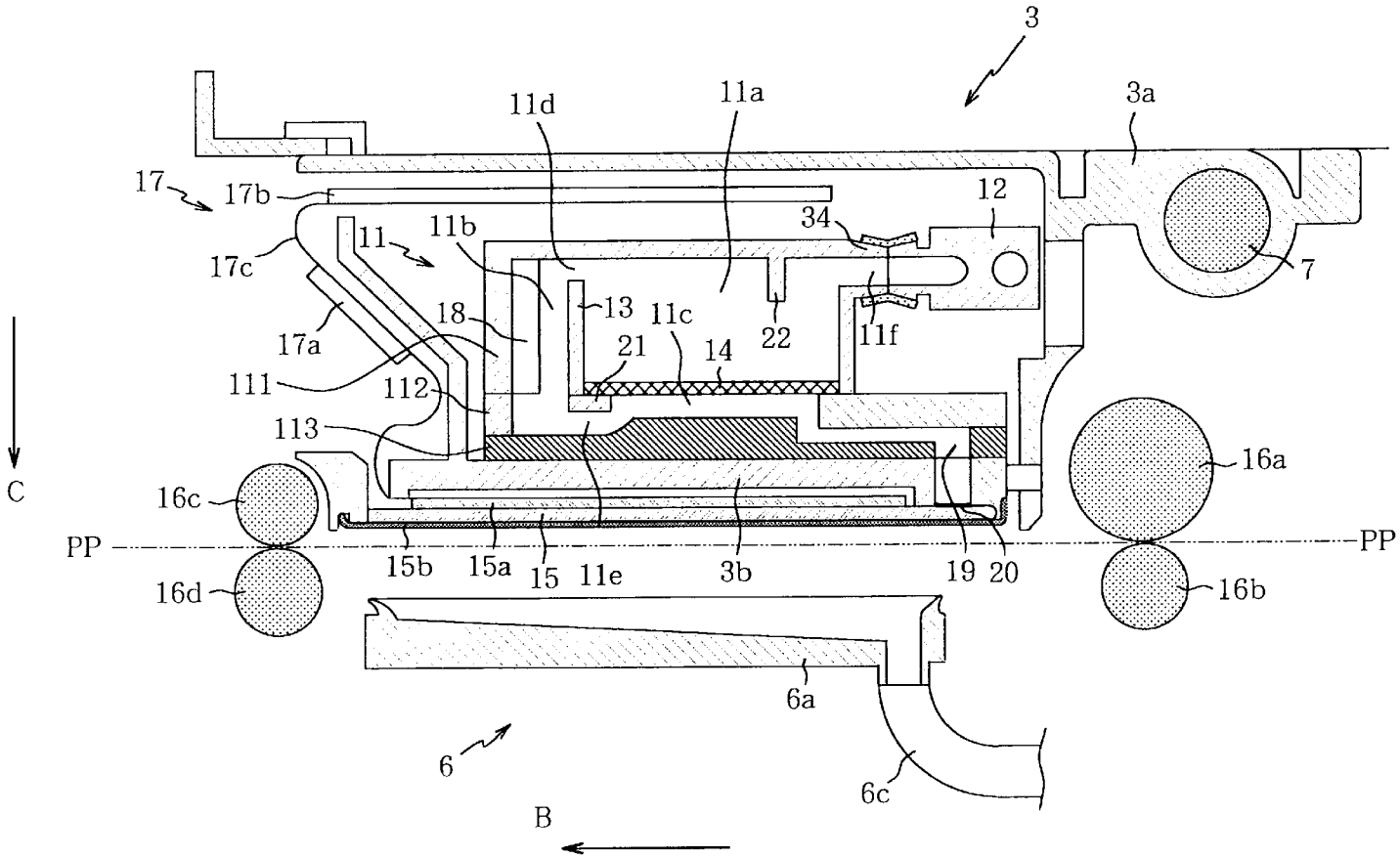
FIG. 9 is a sectional view of the recording head including an air trap unit of a variation of the invention.

As shown in FIG. 9, a second rib 22 protrudes from the upper wall of the first chamber 11*a* of each of the air trap chambers 30 to 33 to absorb a kinetic pressure of ink in the tube 5 generated in accordance with the movement of the carriage 3*a*. All of the air trap chambers 30 to 33 has the same structure, so that explanations will be given to one of the air trap chambers 30 to 33. The second rib 22 is disposed at a position opposed to the ink inlet 11*f* provided in a side wall of the first chamber 11*a*, at a predetermined distance away from the ink inlet 11*f*. The length of the second rib 22 is approximately between 4.5 mm and 5.0 mm, and preferably approximately 4.7 mm. With this structure, a stagnation portion where the flowing ink stagnates, is provided between a space 11*g* and the upper wall provided downstream of the second rib 22 in the ink-flow direction. Therefore, a predetermined amount of air is left in the air trap unit 11 as described below.

Referring to FIGS. 10A to 10G, ink-flow patterns and the condition of the trapped air will be described. FIGS. 10A to 10G schematically show operation of the air trap unit 11 of the variation.

Figure 10A:
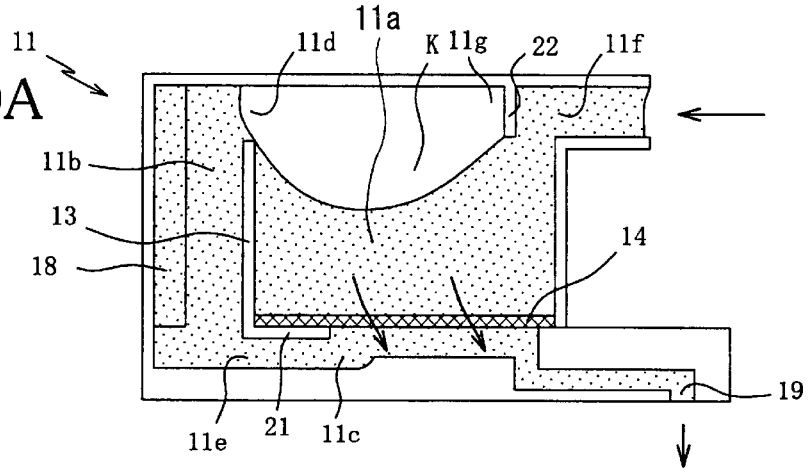
FIGS. 10A to 10G are sectional views schematically showing operation of the air trap unit of the variation of the invention.

FIG. 10A shows the air trap unit 11 wherein an appropriate amount of air is trapped after a certain time has elapsed since the reset purging operation was finished. When the recording operation is performed, ink stored in the first chamber 11*a* flows into the third chamber 11*c* through the filter 14, and then the ink is supplied to the recording head 15 from the third chamber 11*c*. In accordance with consumption of the ink in the air trap chamber 11, ink stored in the ink tank 4 is supplied to the first chamber 11*a* via the tube 5. At that time, air bubbles contained in the ink also flows into the first chamber 11*a* with the ink. The air bubbles move up to the upper portion of the first chamber 11*a* by its own buoyancy and accumulate at the upper portion, thereby becoming an air bubble K.

The ink level of the second chamber 11*b* is raised to the first connecting portion 11*d* by the capillary action of the rib 18. Thus, even when the air bubble K in the first chamber 11*a* becomes large and this results in lowering the ink level of the first chamber 11*a,* the ink level of the second chamber 11*b* is still maintained at the first connecting portion 11*d.* The first connecting portion 11*d* is a substantially rectangular hole having a width of approximately 3.5 mm and a height of approximately 1.5 mm, so that the ink level maintained at the first connecting portion 11*d* forms a concave meniscus. Accordingly, the ink maintained at the first connecting portion 11*d* in the second chamber 11*b* do not flow into the first chamber 11*a,* thereby maintaining the ink level in the second chamber 11*b* at the first connecting portion 11*d.*

Figure 10B:
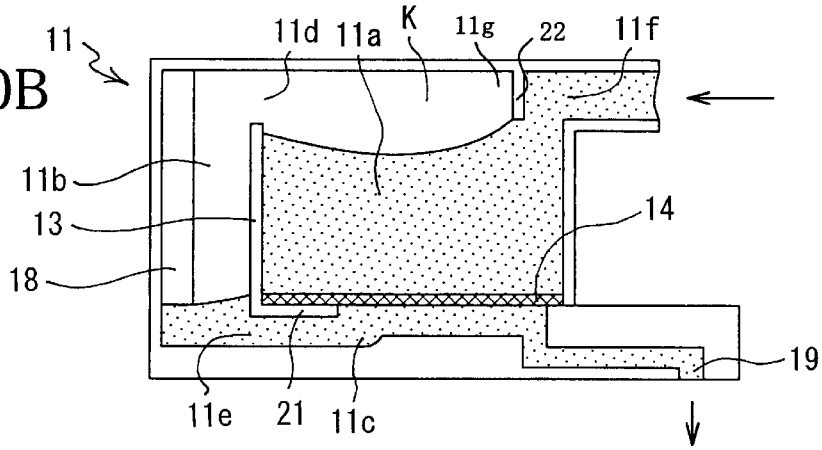

FIG. 10B shows a state of the inside of the air trap unit 11 at the normal purging operation. The normal purging operation is a process to discharge air bubbles and paper dust, which may clog the nozzles, from the nozzles. At this operation, suction is performed with respect to the recording heads 15 with pressure higher than that at the recording operation, so that the ink in the air trap unit 11 flows fast. The high-speed ink-flow, generated by the suction, is regulated to go from the first chamber 11*a* to the third chamber 11*c* by a resistance of the filter 14. Thus, the ink in the first chamber 11*a* goes into the second chamber 11*b* through the first connecting portion 11*d,* and then goes into the third chamber 11*c* through the second connecting portion 11*e.* The resistance of the filter 14 to the high-speed ink-flow is large under the high pressure. Therefore, ink-flow is generated from the first chamber 11*a* to the third chamber 11*c* through the second chamber 11*b,* which have the less resistance to the ink-flow.

The air bubble K trapped in the first chamber 11*a* is drawn into the second chamber 11*b* by the normal purging operation, because the lower portion of the second chamber 11*b* communicates with the third chamber 11*c* via the second connecting portion 11*e* so that the resistance to the ink-flow in the second chamber 11*b* is smaller than the resistance of the filter 14 to the ink-flow. The pressure to be produced at the normal purging operation is lower than that to be produced at the reset purging operation. The normal purging operation is performed using such the pressure in a condition where the ink level in the second chamber 11*b* is maintained at the first connecting portion 11*d* by the capillary action of the rib 18. Therefore, the air bubble K led to the second chamber 11*b* is not further led to the third chamber 11*c.* Accordingly, at the normal purging operation, air trapped in the air trap unit 11 is not discharged from the nozzles, but air bubbles and paper dust, which may clog the nozzles, are sucked and discharged from the recording head unit 3.

Figure 10C:
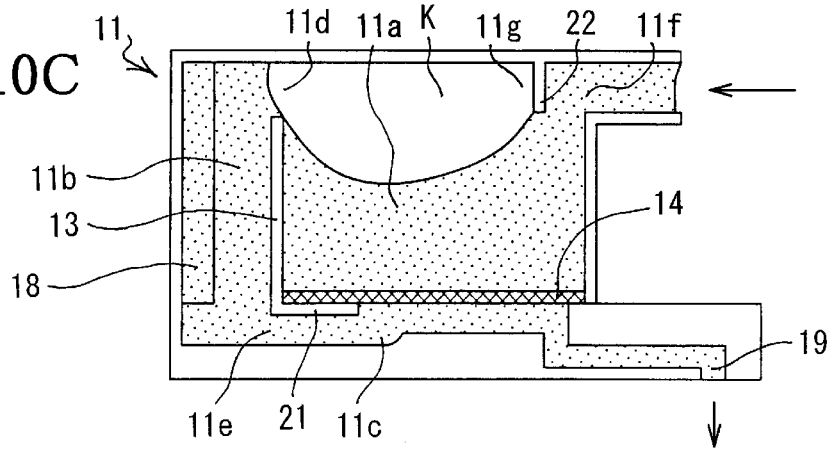

FIG. 10C shows a condition of the air trap unit 11 after the normal purging operation. The air bubble K, once drawn into the second chamber 11*b* by the normal purging operation as shown in FIG. 10B, moves up by its own buoyancy and the capillary action of the rib 18, and is led to the first chamber 11*a* again and trapped therein.

Figure 10D:
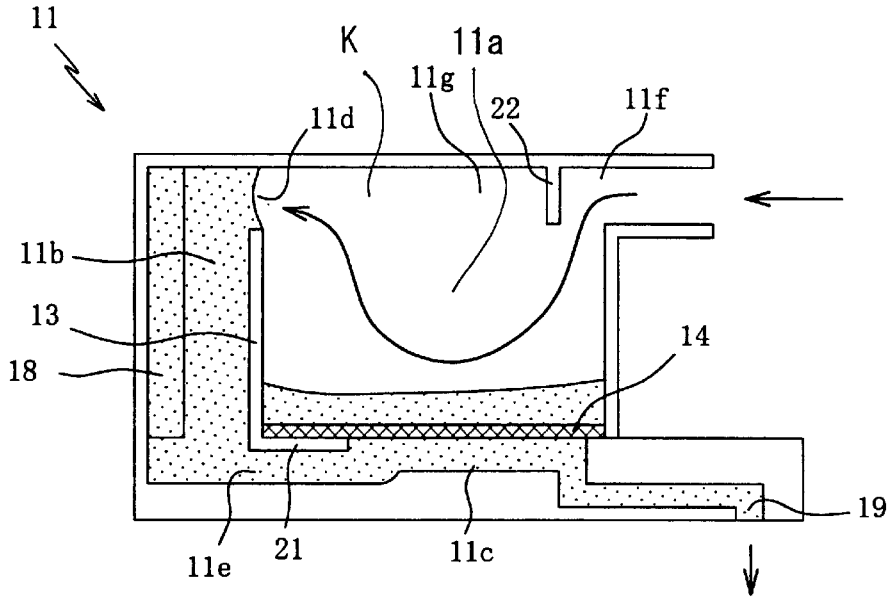

FIG. 10D is a sectional view of the air trap unit 11, in which a large amount of air is trapped in the air trap unit 11*a,* in a condition immediately before the reset purging operation is performed.

Figure 10E:
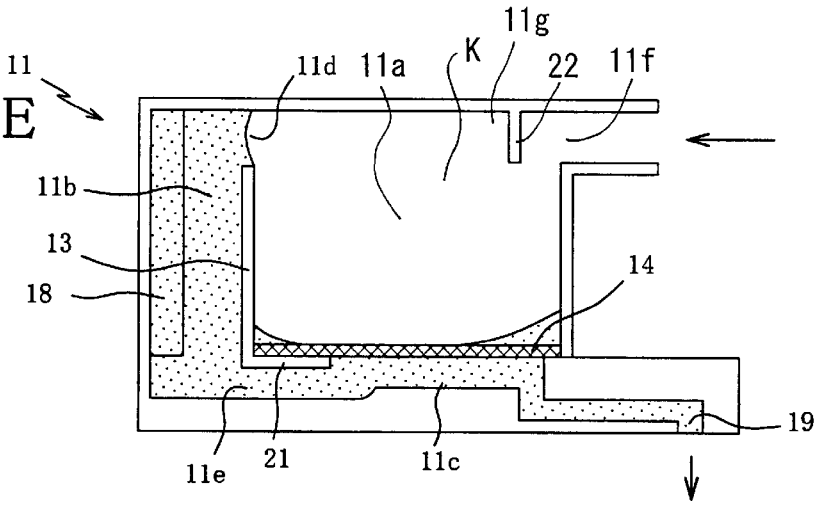

FIG. 10E shows the air trap unit 11 wherein the volume of trapped air is increased. The air trap unit 11 traps a large amount of air in the first chamber 11*a,* which may cause an ink ejection failure for lack of ink. In the ink-jet recording apparatus 1 of the embodiment, it is assumed that such the condition will occur by approximately one month. However, a period of the occurrence of such the condition can be set arbitrarily.

Figure 10F:
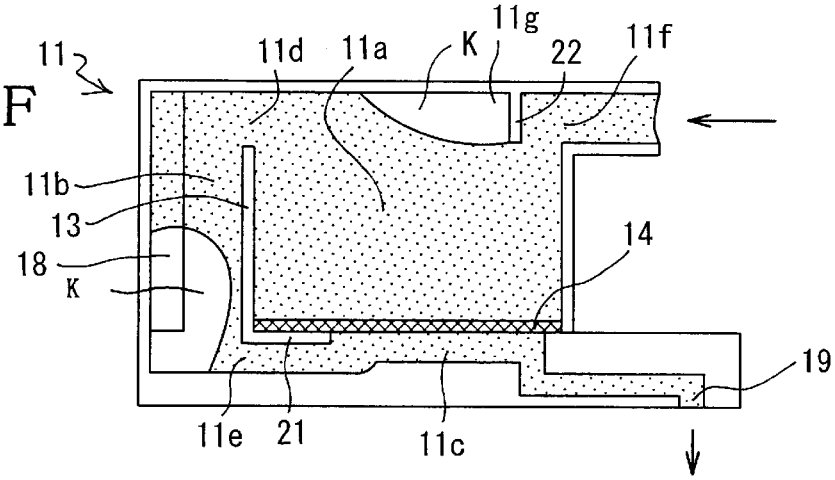

FIG. 10F shows a condition of the air trap unit 11 at the reset purging operation. When the condition of the air trap unit 11 becomes that as shown in FIG. 10E, the reset purging operation is performed. The reset purging operation is to discharge excessive air trapped in the first chamber 11*a.* At the reset purging operation, the recording heads 15 are sucked using pressure higher than that produced at the normal purging operation, so that a high-speed ink-flow is regulated to flow from the first chamber 11*a* to the third chamber 11*c.* In this case, similar to the normal purging operation, an ink-flow that goes from the first chamber 11*a* to the second chamber 11*b* and then goes to the third chamber 11*c* via the first and second connecting portions 11*d* and 11*e,* is generated.

The air bubble K trapped in the first chamber 11*a* is also sucked and discharged through the first to third chambers 11*a* to 11*c,* along the ink-flow. At the normal purging operation, the air bubble K is not led to the third chamber 11*c.* At the reset purging operation, however, the force of the suction is stronger than that at the normal purging operation, so that the air bubble K is led to the third chamber 11*c* through the second chamber 11*b.* The cross-sectional area of the second connecting portion 11*e* is smaller than that of the second chamber 11*b* orthogonal to the ink-flow direction in the second chamber 11*b.* Accordingly, the speed of the ink passing through the second connecting portion 11*e* becomes fast, and thus, the air K can be mightily discharged with the ink from the nozzles. The second chamber 11*b* and the third chamber 11*c* meets at substantially right angles to connect each other. With this structure, the ink-flow stagnates at the corner (the intersection of the second chamber 11*b* and the third chamber 11*c*). As a result, part of the air K remains at the stagnation portion. A large amount of ink is supplied from the ink tank 4 to fill the air trap unit 11 with ink by the reset purging operation.

Figure 10G:
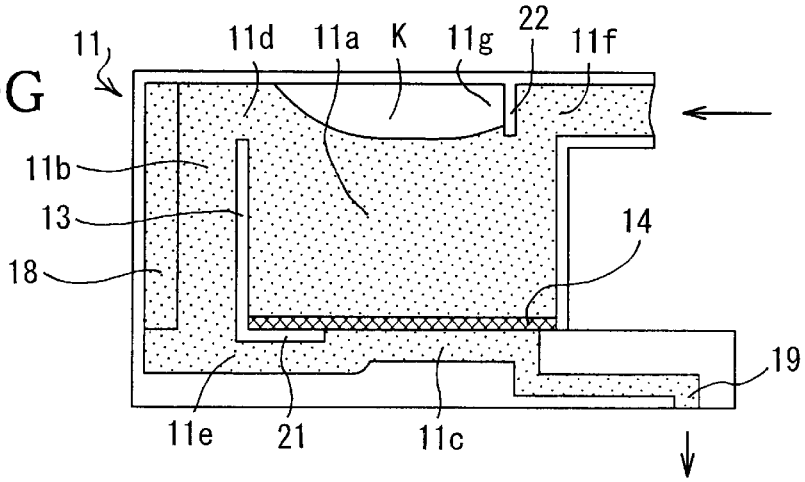

FIG. 10G shows the air trap unit 11 after the reset purging operation. At the reset purging operation, the ink-flow from the first chamber 11*a* to the second chamber 11*b* via the opening portion 11*d,* is generated. Therefore, the space 11*g* is the stagnation portion, so that the ink flows at low speed in the space 11*g.* Accordingly, as shown in FIG. 10F, air stored in the space 11*g* is not discharged even when most of the air K in the first chamber is discharged by the reset purging operation. Thus, the air stays in the first chamber 11*a.* As shown in FIG. 10F, air K remaining in the second chamber 11*b* moves up to the upper portion of the second chamber 11*b* by its own buoyancy and the capillary action of the rib 18 in the second chamber 11*b.* Then, the air K goes into the first chamber 11*a* via the first connecting portion 11*d* and thus the air K combines the air stored in the space 11*g* at the upper portion of the first chamber 11*a.* As described above, the first connecting portion 11*d* maintains the ink level of the second chamber 11*b* thereat and is a large enough to pass the residual air K therethrough from the second chamber 11*b* to the first chamber 11*a.* The residual air K trapped in the first chamber 11*a* absorbs a kinetic pressure due to inertia of the ink in the tube 5 in accordance with the movement of the carriage 3*a.* The amount of residual air is preferably between 0.05 cc and 0.2 cc.

Figure 11:
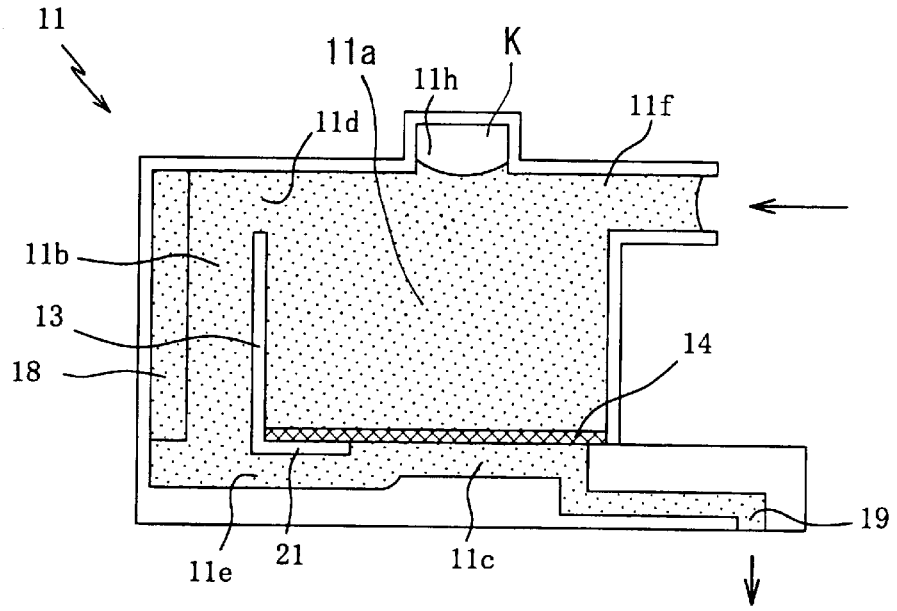
FIG. 11 is a sectional view of an air trap unit of another variation.

The residual air K, as shown in FIG. 10F, is not necessarily required. If the space 11*g* ensures a sufficient amount of air therein, it is unnecessary to remain air purposely. Alternatively, as shown in FIG. 11, a space 11*h* may be provided in the upper wall of the first chamber 11*a* to obtain air for absorbing kinetic pressure.

As described above, according to the ink-jet recording apparatus 1 using the air trap unit 11 having the second rib 22, even when air trapped in the air trap chambers 30 to 33 is discharged by the reset purging operation (S4), a predetermined amount of air remains in the first chamber 11*a* in the space 11*g*. Consequently, a kinetic pressure due to inertia of the ink in the tube 5 in accordance with the movement of the carriage 3*a* can be absorbed by the residual air.

Even when air trapped in the air trap unit 11 is discharged using the purge unit 6, a predetermined amount of air remains at the space 11*g* in the air trap unit 11. Therefore, the kinetic pressure of the ink transmitted to the air trap unit 11 can be absorbed by the residual air. Thus, excellent recording quality can be maintained. Further, the space 11*g* is defined by the second rib 22, provided at the upper wall of the air trap unit 11 so as to be orthogonal to the ink-flow direction, and the upper wall of the air trap unit 11 provided downstream of the second rib 22 in the ink-flow direction. Accordingly, the space 11*g* can be easily provided in the air trap unit 11.

The second rib 22 is provided at a predetermined distance away from the ink inlet 11*f* so as to be opposite to the ink inlet 11*f*. Therefore, the second rib 22 does not interfere with the ink-flow from the ink inlet 11*f*, and the predetermined amount of air can be left in the air trap unit 11.

The vertical length of the second rib 22 is approximately between 4.5 mm and 5.0 mm, so that air of an amount of approximately between 0.05 cc and 0.20 cc can be left in the air trap unit 11.

Air bubbles generated in the tube 5 are trapped in the air trap unit 11 provided at some midpoint in the ink passage. Therefore, the air bubbles, which may clog the nozzles, do not reach the recording heads 15, so that an occurrence of the ink ejection failure can be avoided. Further, the predetermined amount of air remains in the first chamber 11*a* even when the ink-flow is generated by the purge unit 6. Therefore, a kinetic pressure of the ink can be absorbed by the remaining air.

According to the ink-jet recording apparatus 1 of the invention including the air trap unit 11 of the embodiment and the variation, the following effects can be obtained.

Air bubbles generated in the tube 5 are trapped in the air trap unit 11 provided at some midpoint in the ink passage. Therefore, the air bubbles, which may clog the nozzles, do not reach the recording heads 15, so that an occurrence of the ink ejection failure can be avoided. Further, the filter 14 regulates the ink-flow that goes from the first chamber 11*a* to the third chamber 11*c* via the filter 14, in order to generate the high-speed ink-flow that passes through the first, second and third chambers 11*a*, 11*b*, 11*c*. By doing so, the air trapped in the first chamber 11*a* is discharged from the recording head unit 3. Therefore, the function of the air trap unit 11 filled with the air can be reestablished, so that the air trap unit 11 can trap the predetermined amount of air again.

The filter 14 is the meshed net having openings, and also serves as the bottom wall of the first chamber 11*a*. The mesh of the filter 14 can increase the resistance to the ink-flow when the ink passes through the filter 14. With this structure, when the recording operation using the weak suction force is performed, the ink-flow that goes from the first chamber 11*a* to the third chamber 11*c* via the filter 14 can be generated. On the other hand, when the purging operation using the strong suction force is performed, the filter 14 becomes resistant to the ink. Therefore, the ink-flow that passes through the first, second and third chambers 11*a*, 11*b*, 11*c* can be generated.

The ink-jet recording apparatus 1 includes the normal purge program 92*b* to perform the normal purge operation, which is to purge an amount of ink so that the air trapped in the first chamber 11*a* can stay therein. Thus, air bubbles and paper dust, which may clog the nozzles of the recording heads 15, can be discharged without discharging the air trapped in the first chamber 11*a*. Accordingly, the amount of ink wasted during the normal purging operation can be reduced.

In the second chamber 11*b*, the rib 18 is provided that raises the ink level to the first connecting portion 11*e* in the second chamber 11*b* by capillary action. Therefore, the level of ink is maintained at the upper portion of the second chamber 11*b*, so that the air trapped in the first chamber 11*a* can be prevented from entering the third chamber 11*c* by passing through the second chamber 11*b*.

The rib 18 protrudes from the inner surface of the second chamber 11*b* so as to extend vertically. Thus, the second chamber 11*b* is divided by the rib 18 in the vertical direction, so that the capillary action by the rib 18 can be effectively caused.

In the air trap unit 11, the first chamber 11*a* and the second chamber 11*b* are provided next to each other. The first chamber 11*a* and the second chamber 11*b* are connected with each other at the upper portion via the first connecting portion 11*d*. The lower end of the second chamber 11*b* is connected with the third chamber 11*c* via the second connecting portion lie. Accordingly, the first chamber 11*a*, the second chamber 11*b*, and the third chamber 11*c* can be well arranged to provide the compact air trap unit 11.

The cross-sectional area of the second connecting portion 11*e*, provided between the second chamber 11*b* and the third chamber 11*c*, is smaller than that of the second chamber 11*b* orthogonal to the ink-flow direction in the second chamber 11*b*. At the purging operation, the speed of the ink passing through the second connecting portion 11*e* can become fast. Thus, the air can be discharged out of the recording heads 15 from the third chambers 11*c* along the high-speed ink-flow.

The second chamber 11*b* has a portion for staying air that cannot be discharged along the ink-flow generated by the reset purging operation. Accordingly, the air remaining the second chamber 11*b* can be used to absorb a kinetic pressure of the ink.

The longer sides of the filter 14 extend in the direction perpendicular to the width direction of the partition 13. Therefore, an effective area of the filter 14, as the ink passage, can be ensured in the direction perpendicular to the width direction of the partition 13.

While the invention has been described in detail with reference to a specific embodiment thereof, it would be apparent to those skilled in the art that various changes and modifications may be made therein without departing from the spirit of the invention.

What is claimed is:

1. An ink-jet recording apparatus comprising:

a recording head that has at least one ink nozzle and performs recording onto a recording medium by ejecting ink from the ink nozzle;

an ink supply source that stores ink to be supplied to the recording head;

an ink passage that is connected to the ink supply source to supply ink from the ink supply source to the recording head;

an air trap chamber that has an upper wall, a bottom wall, side walls and is connected to the ink passage to store air generated in the ink passage; and, a purge device that generates an ink-flow that flows from the air trap chamber to the recording head and is faster than an ink-flow generated at the recording operation;

wherein the air trap chamber further includes:

a partition that divides the air trap chamber into a first chamber connecting with the ink supply source, a second chamber, and a first connecting portion that communicates the first chamber with the second chamber above the partition; and a filter that further divides the air trap chamber and defines a third chamber at a recording head side and connects the first chamber and a lower end of the second chamber with the recording head, the filter being provided to allow the ink to flow from the first chamber to the third chamber through the filter and provide resistance to the high-speed ink-flow generated by the purge device such that air is separated from the ink which enters the air trap chamber and is trapped at an upper portion of the first chamber, and the air trapped in the first chamber is discharged from the nozzles by a suction supplied by the purge device that generates the high-speed ink-flow that passes the first, second and third chambers in order.

2. The ink-jet recording apparatus according to claim 1, wherein the filter has longer sides and shorter sides, and the longer sides of the filter extend in a direction perpendicular to the partition and the shorter sides of the filter extend in a direction parallel with the partition.

3. The ink-jet recording apparatus according to claim 1, wherein said purge device can be operated in such a manner that purges an amount of ink and allows air trapped in the first chamber to stay therein.

4. The ink-jet recording apparatus according to claim 1, wherein the second chamber has a capillary action generating device that raises a level of the ink stored in the second chamber to the first connecting portion.

5. The ink-jet recording apparatus according to claim 4, wherein the capillary action generating device is a rib that protrudes from an inner surface of the second chamber and extends in a vertical direction.

6. The ink-jet recording apparatus according to claim 1, wherein, in the air trap chamber, the second chamber is provided next to the first chamber, an upper end of the second chamber connects the first chamber via the first connecting portion, and the air trap chamber has a second connecting portion that connects a lower end of the second chamber with the third chamber.

7. The ink-jet recording apparatus according to claim 6, wherein a cross-sectional area of the second connecting portion between the second chamber and the third chamber is smaller than a cross-sectional area of the second chamber orthogonal to the ink-flow direction in the second chamber.

8. The ink-jet recording apparatus according to claim 6, wherein the second chamber meets the third chamber to define a right angle to retain a portion of air and prevent the retained portion of air from being discharged along the ink-flow generated by the purge device.

9. The ink-jet recording apparatus according to claim 8, wherein the retained air is approximately between 0.05 cc and 0.20 cc.

10. The ink-jet recording apparatus according to claim 1, further comprising an air storage portion that is provided in the upper wall of the first chamber and stays a predetermined amount of air even when the high-speed ink-flow is generated by the purge device.

11. The ink-jet recording apparatus according to claim 10, wherein in the air trap chamber, the second chamber is provided next to the first chamber, an upper end of the second chamber connects the first chamber via the first connecting portion, and the air trap chamber has a second connecting portion that connects a lower end of the second chamber with the third chamber.

12. The ink-jet recording apparatus according to claim 10, wherein the filter has longer sides and shorter sides, and the longer sides of the filter extends in a direction perpendicular to the partition and the shorter sides of the filter extends in a direction parallel with the partition.

13. An ink-jet recording apparatus comprising:

a recording head that has at least one ink nozzle and performs recording onto a recording medium by ejecting ink from the ink nozzle;

an ink supply source that stores ink to be supplied to the recording head;

an ink passage that is connected to the ink supply source to supply ink from the ink supply source to the recording head;

an air trap chamber that has an upper wall, a bottom wall, side walls and is connected to the ink passage to store air generated in the ink passage;

a purge device that generates an ink-flow that flows from the air trap chamber to the recording head and is faster than an ink-flow generated at the recording operation;

wherein the air trap chamber further includes:

a rib that protrudes from the upper wall of the air trap chamber so as to extend in a direction orthogonal to an ink-flow direction; and an air storage portion that is defined by the rib and the upper wall provided downstream of the rib in the ink-flow direction to store a predetermined amount of air even when the high-speed ink-flow is generated by the purge device.

14. The ink-jet recording apparatus according to claim 13, wherein the side wall of the air trap chamber has an inlet, through which the ink supplied from the ink supply source flows into the air trap chamber, at its upper portion, and the rib is disposed at a predetermined distance away from the inlet to be opposite to the ink inlet.

15. The ink-jet recording apparatus according to claim 13, wherein an amount of air remaining in the air storage portion by the purge device is approximately between 0.05 cc and 0.20 cc, and a vertical length of the rib is approximately between 4.5 mm and 5.0 mm.

16. The ink-jet recording apparatus according to claim 13, wherein the air trap chamber further comprises:

a partition that divides inside of the air trap chamber into a first chamber connecting with the ink supply source and a second chamber, and is provided in the air trap chamber so as to provide a connecting portion that communicates the first chamber with the second chamber above the partition; and a flow regulation device that further divides a lower portion of the air trap chamber to define a third chamber that is provided at a recording head side and connects the first chamber and a lower end of the second chamber with the recording head, the regulation device allows the ink to flow from the first chamber to the third chamber through the regulation device and offers resistance to the high-speed ink-flow generated by the purge device, wherein the air storage portion is provided in the first chamber.

17. The inkjet recording apparatus according to claim 13, wherein the second chamber has a capillary action generating device that raises a level of the ink stored in the second chamber to the connecting portion.

18. The ink-jet recording apparatus according to claim 17, wherein the capillary action generating device is a rib that protrudes from an inner surface of the second chamber and extends in a vertical direction.

19. A computer program embodied on a computer readable storage medium for performing a reset purging operation on an ink-jet recording apparatus, where said ink-jet recording apparatus includes a recording head unit, an airtrap unit, a purge unit, and a purge motor, the computer program comprising:

code for moving the recording head unit to a position adjacent to the purge unit;

code for directing the purge unit to attach to the recording head unit;

code for directing the purge motor to operate the purge unit to apply a suction force to the recording head such that a portion of air trapped in the air trap unit is discharged and a remaining portion of air trapped in the air trap unit is retained in the air trap unit; and code for directing the purge unit to detach from the recording head unit.

20. The computer program of claim 19 further including code for detecting the amount of time that has lapsed since the last reset purging operation was performed.

21. The computer program of claim 19 further including code for directing the purge motor to operate the purge unit to apply a suction force of 80 kPa to the recording head.

22. A method for discharging an air bubble contained within an airtrap unit of an inkjet recording apparatus, where the airtrap unit includes a first chamber, a second chamber, a third chamber, a first connecting portion for connecting the first chamber and the second chamber, and a second connecting portion for connecting the second chamber with the third chamber, said method comprising the steps of:

(1) applying a pressure to the airtrap unit;

(2) generating an inkflow from the first chamber to the second chamber, via the first connecting portion, such that the air bubble is transferred from the first chamber to the second chamber;

(3) generating an inkflow from the second chamber to the third chamber, via the second connecting portion, such that the air bubble is transferred from the second chamber to the third chamber and discharge from the airtrap unit;

(4) retaining a portion of the air bubble in the second chamber; and (5) returning the retained portion of the air bubble to the first chamber to absorb a kinetic pressure generated by the operation of the ink-jet recording apparatus.

23. The method of claim 22 wherein the portion of the air bubble retained falls within a range of 0.05 cc and 0.2 cc.

24. A method for discharging an air bubble contained within an airtrap unit of an ink-jet recording apparatus, where the airtrap unit includes a first chamber, a second chamber, a third chamber, a first connecting portion for connecting the first chamber and the second chamber, and a second connecting portion for connecting the second chamber with the third chamber, said method comprising the steps of:

(1) applying a pressure to the airtrap unit;

(2) generating an inkflow from the first chamber to the second chamber via the first connecting portion;

(3) generating an inkflow from the second chamber to the third chamber via the second connecting portion;

(4) retaining a first portion of the air bubble in the first chamber, retaining a second portion of the air bubble in the second chamber and discharging a third portion of the air bubble from the third chamber; and (5) returning the second retained portion of the air bubble to the first chamber;

(6) combining the second retained portion of the air bubble with the first retained portion of the air bubble to create a single retained portion of the air bubble to absorb a kinetic pressure generated by the operation of the ink-jet recording apparatus.

25. The method of claim 24 wherein the single retained portion of the air bubble retained falls within a range of 0.05 cc and 0.2 cc.

26. An ink-jet recording apparatus comprising:

a recording head that has at least one ink nozzle and performs recording onto a recording medium by ejecting ink from the ink nozzle;

an ink supply source that stores ink to be supplied to the recording head;

an ink passage that is connected to the ink supply source to supply ink from the ink supply source to the recording head;

an air trap chamber that has an upper wall, a bottom wall, side walls and is connected to the ink passage to store air generated in the ink passage; and, a purge device that generates an ink-flow that flows from the air trap chamber to the recording head and is faster than an ink-flow generated at the recording operation;

wherein the air trap chamber further includes:

a partition that divides the air trap chamber into a first chamber connecting with the ink supply source, a second chamber, and a first connecting portion that communicates the first chamber with the second chamber above the partition, where a surface of the partition is made of resin material which is nonrepellant to ink; and a flow resistant member that further divides the air trap chamber and defines a third chamber at a recording head side and connects the first chamber and a lower end of the second chamber with the recording head, the flow resistant member being provided to allow the ink to flow from the first chamber to the third chamber through the flow resistant member and to also provide resistance to the high-speed ink-flow generated by the purge device such that air is separated from the ink which enters the air trap chamber and is trapped at an upper portion of the first chamber, and the air trapped in the first chamber is discharged from the nozzles by a suction supplied by the purge device that generates the high-speed ink-flow that passes the first, second and third chambers in order.

* * * * *